US006383047B1

(12) United States Patent
Minami et al.

(10) Patent No.: US 6,383,047 B1
(45) Date of Patent: May 7, 2002

(54) METHOD FOR MANUFACTURING CATHODE, ELECTRON SOURCE, AND IMAGE FORMING APPARATUS

(75) Inventors: Masato Minami, Atsugi; Takashi Iwaki, Machida, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/388,427

(22) Filed: Sep. 2, 1999

(30) Foreign Application Priority Data

| | | |
|---|---|---|
| Sep. 7, 1998 | (JP) | 10-253039 |
| Oct. 6, 1998 | (JP) | 10-283659 |
| Feb. 12, 1999 | (JP) | 11-033880 |
| Jul. 30, 1999 | (JP) | 11-217950 |

(51) Int. Cl.[7] ..... H01J 9/02
(52) U.S. Cl. ..... 445/6; 445/24
(58) Field of Search ..... 445/6, 24, 51

(56) References Cited

U.S. PATENT DOCUMENTS

| | | | | |
|---|---|---|---|---|
| 5,591,061 A | * | 1/1997 | Ikeda et al. | 445/6 |
| 5,674,100 A | * | 10/1997 | Ono et al. | 445/24 |
| 5,986,389 A | * | 11/1999 | Tsukamoto | 313/309 |

FOREIGN PATENT DOCUMENTS

| | | |
|---|---|---|
| EP | 0788130 | 8/1997 |
| EP | 0 803 890 A1 | 10/1997 |
| JP | 7-065704 | 2/1995 |
| JP | 7-65704 | 3/1995 |
| JP | 7-235255 | 9/1995 |
| JP | 8-007749 | 1/1996 |
| JP | 8-055563 | 2/1996 |
| JP | 8-171850 | 7/1996 |
| JP | 8-180803 | 7/1996 |
| JP | 8-321254 | 12/1996 |
| JP | 9-069334 | 3/1997 |
| JP | 9-161666 | 6/1997 |
| JP | 9-237571 | 9/1997 |
| JP | 10-40807 | 2/1998 |
| JP | 2836015 | 10/1998 |

* cited by examiner

*Primary Examiner*—Kenneth J. Ramsey
(74) *Attorney, Agent, or Firm*—Fitzpatrick, Cella, Harper & Scinto

(57) ABSTRACT

A method for manufacturing a cathode comprises the steps of: a process for applying onto a substrate a fluid mixture comprising polymers or precursors to the polymers, fine particles of electroconductive material or organic metal compound, and solvent; a process for removing the solvent by heating the fluid mixture applied on the substrate, thereby obtaining an electroconductive organic film comprising the polymers and the electroconductive material; and a process for forming a gap at a portion of the electroconductive organic film by applying an electrical current thereto. Accordingly, a simple method for manufacturing cathodes, electron sources, and image forming apparatuses with excellent electron emitting properties can be realized.

28 Claims, 27 Drawing Sheets

STRIPE

MATRIX

PRIOR ART

PRIOR ART

CROSS-SECTION ALONG A-A'

METHOD FOR MANUFACTURING CATHODE, ELECTRON SOURCE, AND IMAGE FORMING APPARATUS

BACKGROUND OF THE INVENTION

1. Field of the Invention

The present invention relates to a method for manufacturing cathodes, and a method for manufacturing electron sources, electron beam generating apparatuses, and image forming apparatuses such as flat-panel displays.

2. Description of the Related Art

There are two types of cathodes (electron-emitting devices) that have been conventionally known; thermionic cathodes, and cold cathodes. Cold cathodes include field-emission types (hereafter referred to as "FE-type"), and metal layer/insulating layer/metal layer types (hereafter referred to as "MIM-type") and surface conduction type cathodes.

Examples of surface conduction type cathodes are disclosed in Japanese Patent Laid-Open No. 8-55563, Japanese Patent Laid-Open No. 7-235255, Japanese Patent Laid-Open No. 8-007749, Japanese Patent Laid-Open No. 8-321254, Japanese Patent No. 2836015, Japanese Patent Laid-Open No. 9-237571, Japanese Patent Laid-Open No. 7-65704, Japanese Patent Laid-Open No. 10-40807, Japanese Patent Laid-Open No. 8-171850, Japanese Patent Laid-Open No. 9-069334, and so forth.

FIG. 12 schematically illustrates an example of the configuration of a surface conduction type cathode, disclosed in the above Japanese Patent Laid-Open No. 8-321254. In the Figure, reference numeral 1 denotes a substrate, 2 and 3 denote electrodes, 4 denotes an electroconductive film, 5 denotes an electron emission portion, and 10 denotes a carbon film. The area near the electron emission portion 5 is formed of a first gap 6 which defines the gap in the electroconductive film, and a second gap 7 which defines the gap in the carbon film 10. The gap L shown in the Figure is set at several tens of $\mu$m to several hundred $\mu$m, the width W at several $\mu$m to several hundred $\mu$m, and the thickness d at several tens of $\mu$m to several hundred $\mu$m.

Also, FIG. 13 illustrates an example of the method of manufacturing a conventional surface conduction type cathode, such as disclosed in the above Japanese Patent Laid-Open No. 8-321254.

First, electrodes 2 and 3 are positioned on the substrate 1 (FIG. 13A). Then, an electroconductive film 4 for connecting the electrodes 2 and 3 is positioned (FIG. 13B). Next, flowing a current through the electroconductive film 4 forms a first gap 6 at a portion of the electroconductive film (FIG. 13C). The process of forming this first gap 6 in the electroconductive film is called "forming" or "energization forming". Next, the carbon film 10 is formed by, for example, introducing an organic gas in a vacuum, and applying voltage between the two electrodes 2 and 3 in this atmosphere (FIG. 13D). Incidentally, the second gap 7 is formed at the same time as forming this carbon film 10. The process of forming the carbon film 10 and the second gap 7 is called "activation". The area near the second gap 7 formed by this activation process is called the electron emission portion 5.

SUMMARY OF THE INVENTION

There have been the following problems with the above-described conventional activation process.

Firstly, in the case of forming the carbon film from organic material gas, there have been the following problems. There is the need to introduce the organic material gas at an optimal gas pressure for the above activation process. Particularly, depending on the type of organic material gas that is to be introduced, there has been problems in pressure controllability in the event that the optimal gas pressure is low. Also, there have been cases wherein the amount of time necessary for the activation process changes or the nature of the formed carbon film differs due to residual water, oxygen, or the like in the vacuum atmosphere. This has caused irregularities in the electron emission properties of electron sources or image forming apparatuses.

Secondly, in the event of using the aforementioned cathodes for image forming apparatuses or electron sources, there have been the following problems. That is following the activation process, the gas used on the activation process, and also water, oxygen, etc., have adhered to the substrate for the electron source, or member comprising the image forming apparatus, e.g., a face plate having fluorescent material. Accordingly, there is the need to remove the gas and the like adhering thereto, to stabilize electron emission properties. To this end, conventional arrangements required a process called "stabilizing", wherein the substrate on which the electron-emitting devices are arrayed, or the air-tight container enveloping the devices, are baked at high temperatures for long periods of time. With this stabilizing process, the higher the temperature, the better; and the longer the time, the better. However, in practice, the stabilizing process is restricted regarding the heating temperature due to the heat-resistance properties of the members comprising the cathodes, electron sources, and image forming apparatuses, so sufficient heating has not always been able to be performed.

Thirdly, in the sealing process for fabricating image forming apparatuses, there have been the following problems. That is, in the case of fabricating image forming apparatuses, conventional arrangements involved bonding together at high temperatures an electron source substrate comprising wires and the like for driving each device with a face plate having fluorescent material or the like, thereby forming an envelope (referred to as the sealing process). Then, following this sealing process, voltage is applied from the wires, the aforementioned forming and activating processes and the like are performed. In this way, the forming and activating processes are performed after the image forming apparatus (vacuum envelope) is assembled, so in the event that a defect occurs on the electron source substrate due to one reason or another, the entire image forming apparatus becomes defective. Accordingly, an arrangement has been awaited wherein the forming and activating processes are performed, and inspected, following which the electron source substrate which has passed the inspection and the face plate are assembled to manufacture the image forming apparatus.

Fourthly, the above Japanese Patent Laid-Open No. 9-237571 discloses a manufacturing method which is said to solve the above problems, but means for realizing further reductions in costs has been awaited.

Accordingly, the present invention has achieved the above objectives, by the following manufacturing methods.

According to an aspect of the present invention, a method for manufacturing a cathode comprises the steps of:

A) a process for applying onto a substrate a fluid mixture comprising polymers or precursors to the polymers, fine particles of electroconductive material or organic metal compound, and solvent;

B) a process for removing the solvent by heating the fluid mixture applied on the substrate, thereby obtaining an electroconductive organic film comprising the polymers and the electroconductive material; and C) a process for forming a gap at a portion of the electroconductive organic film by flowing a current through the film.

Now, the process for applying the fluid mixture according to the present invention may be performed by the ink-jet method, and the ink-jet method may involve applying heat to the fluid mixture to the point of boiling so as to generate bubbles, thereby using the pressure of the bubbles to eject droplets of the fluid mixture.

Also, according to the present invention, the ink-jet method may involve applying electric signals to piezoelectric elements so as to cause deformation thereof, thereby ejecting droplets of the fluid mixture.

The polymers may comprise at least one selected from the following group: all-aromatic polymers, and polyacryllo nitryl. Here, the all-aromatic polymer may comprise one of polyimide, polybenzoimidazole, and polyamideimide.

The electroconductive material according to the present invention may comprise at least one selected from the following group: Pd, Ru, Ag, Cu, Tb, Cd, Fe, Pb, Zn, PdO, $Sno_2$, $In_2O_3$, PbO, $Sb_2O_3$, $HfB_2$, $ZrB_2$, $LaB_6$,$CeB_5$, $YB_4$, $GdB_2$, TiC, ZrC, HfC, TaC, SiC, WC, TiN, ZrN, HfN, polyacetylene, poly-p-phenylene, polyphenylene sulfide, polypyrrole, Si, Ge, carbon, and graphite.

Also, the electroconductive material may comprise at least one selected from the following group: metals, oxides, borides, carbides, nitrides, electroconductive polymers, and semiconductors.

According to another aspect of the present invention, a method for manufacturing a cathode comprises the steps of:

A) a step for forming on a substrate an electroconductive organic film comprising a mixture of:

at least one organic material selected from the following group: all-aromatic polymers, and polyacryllo nitrile; and an electroconductive material; and B) a step for forming a gap at a portion of the electroconductive organic film by flowing a current through the film.

According to yet another aspect of the present invention, a method for manufacturing a cathode comprises the steps of:

A) a step for forming on a substrate an electroconductive film comprising:

at least one organic material selected from the following group: all-aromatic polymers, and polyacryllo nitrile; and an electroconductive material; and B) a step for forming a gap at a portion of the electroconductive organic film by flowing a current through the film.

The all-aromatic polymers here may comprise at least one organic material selected from the following group: polyimide, polybenzoimidazole, and polyamideimide.

According to a further aspect of the present invention, a method for manufacturing a cathode comprises the steps of:

A) a step for forming an electroconductive organic film on a substrate layer; and B) a step for forming a gap at a portion of the electroconductive organic film by flowing a current through the film.

According to another aspect of the present invention, a method for manufacturing an electron source comprising an array of a plurality of cathodes uses cathodes which are manufactured according to any of the methods described above.

The method for manufacturing the above electron source comprises:

A) a step for forming an array of a plurality of pairs of electrodes on a substrate, using offset printing;

B) a step for forming a plurality of X-directional wires coming into common contact with one of the pair of electrodes, on the substrate using screen printing;

C) a step for forming a plurality of Y-directional wires coming into common contact with the other of the pair of electrodes, on the substrate using screen printing;

D) a step for positioning the electroconductive organic film so as to connect between each of the pairs of electrodes, using the ink-jet method; and E) a process for forming a gap at a portion of the electroconductive organic film by flowing a current through the film, via the X-directional wires and the Y-directional wires.

Here, the Y-directional wires are formed over the X-directional wires so as to be electrically insulated therefrom by an insulating layer formed using screen printing, and the Y-direction and the X-direction are substantially perpendicular.

According to yet another aspect of the present invention, the electron source in a method for manufacturing an image forming apparatus comprising an electron source having an array of a plurality of cathodes and image forming members positioned facing the electron source is manufactured according to the aforementioned method for manufacturing electron sources.

Thus, according to the present invention, firstly, control of the pressure of the organic gas being introduced is not necessary as with conventional methods for manufacturing cathodes, the effects of the residual gas in the vacuum atmosphere are relieved, and electron emission properties can be readily controlled.

Also, secondly, with the method for manufacturing cathodes according to the present invention, electron emission portion can be formed to the electroconductive film using heat due to application of electricity or electric energy. Thus, the electron emission properties can easily be controlled according to the power at forming process and/or the thickness of the electroconductive organic film. Accordingly, in the case of manufacturing electron sources or image forming apparatuses wherein a plurality of cathodes are arrayed, control of the electron emission properties can be readily conducted as compared to the activation process of conventional arrangements which require control of the organic gas, providing a simpler process. Consequently, irregularities in electron emission properties can be suppressed.

Also, thirdly, electron sources which have passed inspection and face plates which have passed inspection can be used for the assembly process (bonding process), so the occurrence of defects after assembly of the image forming apparatus can be reduced as compared to the activation process of conventional arrangements which require control of the organic gas. Consequently, the cost of the image forming apparatus can be reduced.

Further, fourthly, with the manufacturing method according to the present invention, there is no need to align the electroconductive film and the organic film as with the conventional manufacturing method wherein the organic film covers the electroconductive film, disclosed in Japanese Patent Laid-open No. 9-237571. Accordingly, defective cathodes and irregularity in electron emission properties owing to offset of the carbon film can be suppressed, thereby providing cathodes with excellent electron emission properties. Further, using the ink-jet method to form organic film having electroconductivity according to the present invention reduces the patterning process for the device, thereby reducing costs. Moreover, forming the electrodes forming the cathodes and the wires for driving the cathodes by printing enables all components of the cathodes and electron sources to be formed by printing processes, realizing even further reductions in costs.

DESCRIPTION OF THE PREFERRED EMBODIMENTS

The following is a detailed description of the basic configuration of a cathode according to the present invention, with reference to the drawings.

Figure 1A:
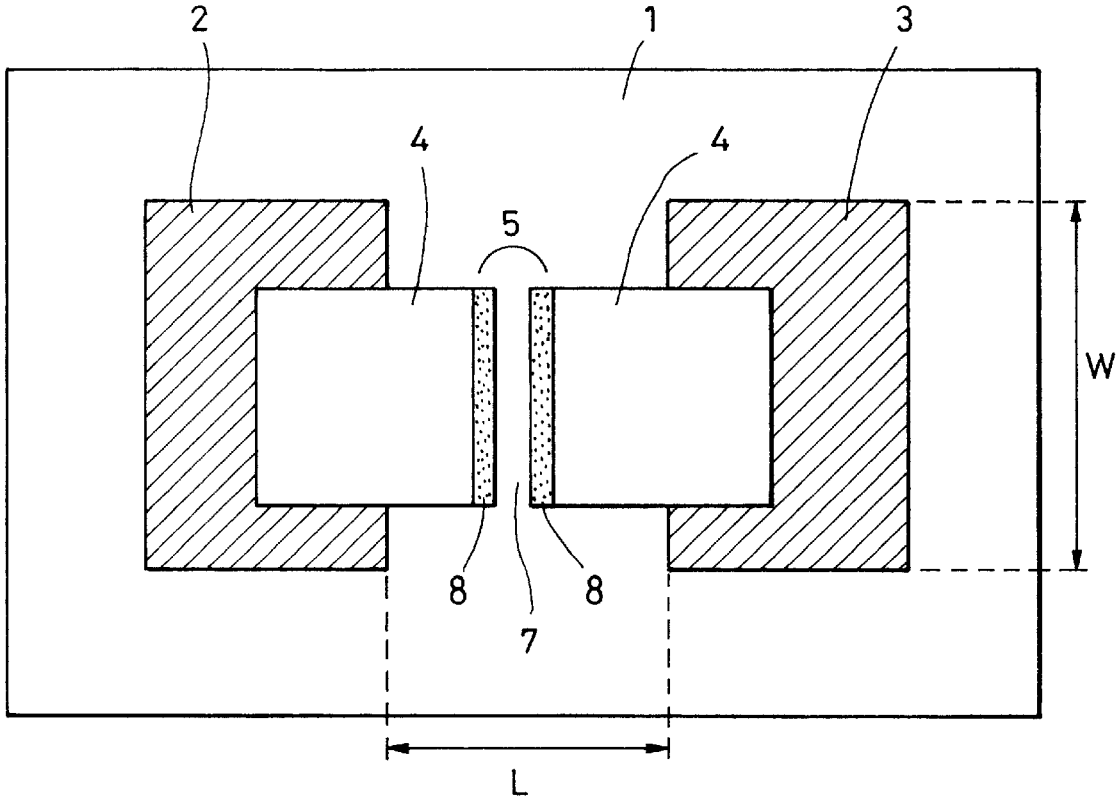
FIG. 1A is a plan view illustrating the configuration of a cathode according to the present invention.
Figure 1B:
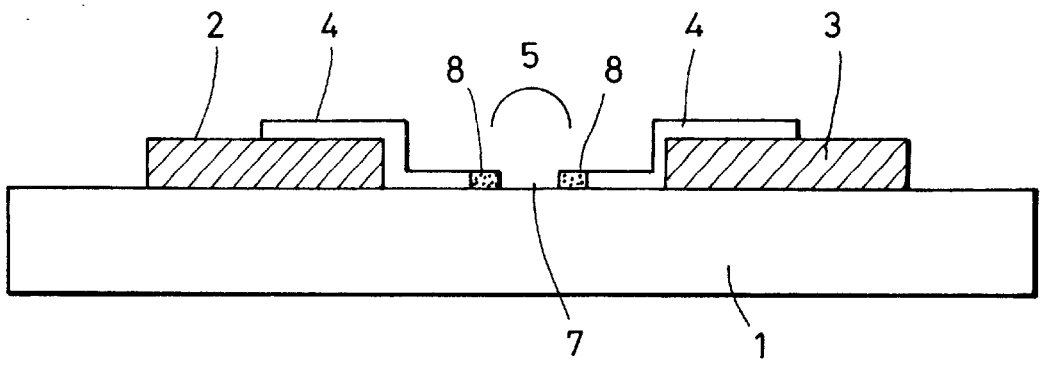
FIG. 1B is a cross-section of the cathode according to the present invention.

FIG. 1A is a schematic plan view illustrating the configuration of a cathode according to the present invention, and FIG. 1B is a cross-section thereof.

In FIG. 1, reference numeral 1 denotes a substrate, 2 and 3 denote electrodes, 4 denotes an organic film having electroconductivity (or, simply referred to as "electroconductive film"), 5 denotes an electron emission portion, and 7 denotes a gap.

Examples of materials used for the substrate 1 include quartz glass, glass wherein the amount of impurities such as Na or the like contained therein has been reduced, soda-lime glass, glass substrates with a layer of $SiO_2$ formed on soda-lime glass by sputtering or the like, ceramics such as alumina, Si substrates, and so forth.

Commonly used conducting materials can be selected and used for the opposing electrodes 2 and 3. Examples include metals such as Ni, Cr, Au, Mo, W, Pt, Ti, Al, Cu, Pd, etc., or alloys thereof; printing conductors formed of glass or the like with metals such as Pd, Ag, Au, $RuO_2$, Pd—Ag, or metal oxides thereof; transparent conductors such as $In_2O_3$—$SnO_2$; semiconductor materials such as polysilicone and the like, and so forth.

The gap L between the electrodes 2 and 3, the length W of the electrodes 2 and 3, the form of the organic film 4 having electroconductivity, etc., are designed taking into consideration the form and the like of application. The gap L between the electrodes 2 and 3 can be set to a range between several tens of nm to several hundred $\mu$m, and preferably is set at a range of several $\mu$m to several ten $\mu$m, taking into consideration the voltage applied between the electrodes 2 and 3, and the like.

The length W of the electrodes 2 and 3 can be set to a range between several $\mu$m to several hundred $\mu$m, taking into consideration the resistance values of the electrodes and the electron emission properties. The thickness d of the electrodes 2 and 3 can be set to a range between several tens of nm to several $\mu$m.

Incidentally, the configuration is not restricted to an arrangement wherein the opposing electrodes 2 and 3 are layered on the substrate 1 and the electroconductive organic film 4 is layered thereupon as shown in FIG. 1B; rather, arrangements may be used wherein the electroconductive organic film 4 is layered on the substrate 1 and the opposing electrodes 2 and 3 are layered thereupon.

The organic film having electroconductivity (or simply "electroconductive film") 4 is a mixed film comprising an electroconductive material (1) and an organic material (2).

Incidentally, the above electroconductive material (1) also includes electroconductive metal compounds.

Also, the resistance value of the above organic film having electroconductivity (electroconductive film) 4 is preferably $10^3$ to $10^7$ Ω/□ for sheet resistance. In the event that the resistance value is smaller than this range, a great current may flow during the later-described forming, causing heating and cracking of the substrate, or desired electron emission properties may not be obtained. In the event that the resistance value is greater than this range, forming may become impossible, or desired electron emission properties may not be obtained.

Further, the thickness of the above organic film having electroconductivity is preferably between several nm to several hundred nm. An even more preferable film thickness is between 1 nm to 100 nm.

Examples of the above electroconductive material (1) include, but are not limited to, the following: Metals such as Pd, Ru, Ag, Cu, Tb, Cd, Fe, Pb, or Zn; oxides such as PdO, $SnO_2$, $In_2O_3$, PbO, $Sb_2O_3$; borides such as $HfB_2$, $ZrB_2$, $LaB_6$, $CeB_6$, $YB_4$, $GdB_4$; carbides such as TiC, ZrC, HfC, TaC, SiC, WC; nitrides such as TiN, ZrN, HfN; electroconductive high polymers such as polyacetylene, poly-p-phenylene; polyphenylene sulfide, polypyrrole; semiconductors such as Si, Ge; carbon; and graphite.

Also, examples of the above electroconductive metal alloys include, but are not limited to, those formed of metals such as Pd, Ru, Ag, Cu, Tb, Cd, Fe, Pb, and Zn.

On the other hand, regarding the organic material (2), a polymer material which readily forms graphite by heating is preferable. Specifically, polymer materials of all-aromatics, or polyacryllonitryl are preferable.

Also, from the perspective of forming film, it is preferable that the material itself or a precursor thereof be soluble in an organic solvent, and further that the material is comprised of a heat-resistant polymer. Accordingly, an all-aromatic polymer material which is itself soluble is particularly preferable.

Examples of the all-aromatic polymer material suitably used with the present invention include polyimide, polybenzoimidazole, polyamideimide, and so on. Materials other than the above-mentioned may also be used, as long as these satisfy the above conditions.

Graphite is preferable for the element according to the present invention, as it is effective regarding life, electric discharge, cathode destruction due to uncontrolled emission, and so forth.

<Description of the method for manufacturing cathodes>

An example of the method for manufacturing cathodes according to the present invention will be described with reference to FIGS. 1A–1B and 2. FIGS. 2A–2D bear the same reference numerals for parts that are equivalent to those shown in FIG. 1. FIG. 1A is a plan view illustrating the configuration of a cathode according to the present invention, and FIG. 1B is a cross-section thereof. FIGS. 2A–2D are schematic diagrams illustrating an example of the process for manufacturing the cathode according to the present invention.

Figure 2A:
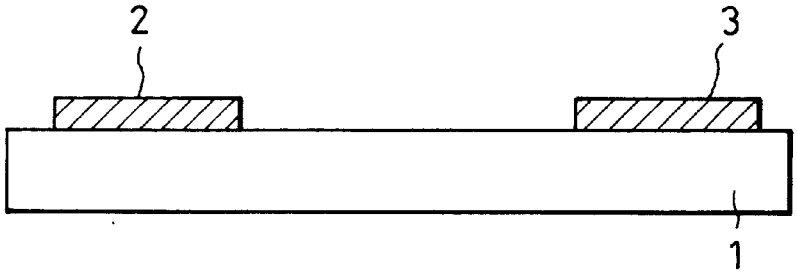
FIGS. 2A–2D are schematic diagrams illustrating an example of the process for manufacturing a cathode according to the present invention.

1) The substrate 1 is thoroughly cleansed using detergent, pure water and an organic solvent, and so forth, and electrode material is laid thereupon by vacuum deposition, sputtering, etc., following which the electrodes 2 and 3 are formed on the substrate 1 using photolithography, for example (FIG. 2A).

Now, this example has been described using the photolithography method, but the method for forming the electrodes is not restricted to this; rather, the ink-jet method, printing, or other methods may be used. Particularly, offset printing method allows formation over large areas with high precision, and is thus preferable.

Figure 2B:
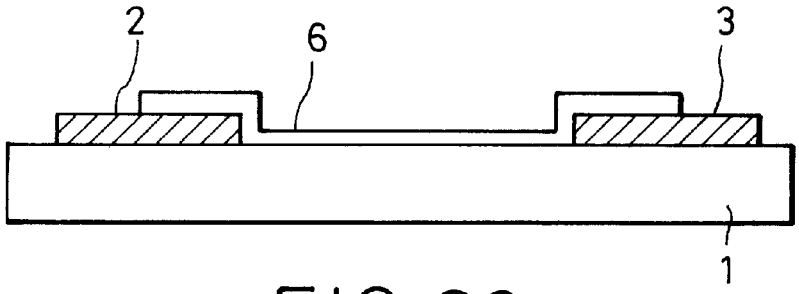

2) Now, a mixed fluid 6 prepared by mixing (dispersing) a solvent comprised of N,N-dimethyl acetoamide, fine graphite particles, poly(pyromellitamic acid dimethylester) is applied to the substrate 1 upon which the electrodes 2 and 3 are provided, using a spinner (FIG. 2B).

Incidentally, this description uses the fine graphite particles as the electroconductive material (1); however, other fine particle materials can be selected from the above-mentioned examples for the electroconductive material (1) and used instead of the above electroconductive fine graphite particles.

The particle diameter of the electroconductive fine particles which can be used with the present invention is within a range of 10 μm or smaller, and more preferably, within a range of 1 μm or smaller. Also, the example given here involves using electroconductive fine particles. However, material is also preferably used which is capable of forming the above-described electroconductive material (1) by the heating processing in the next process, instead of the fine particles. Organic metal compounds such as organic metal complexes of the metals listed as examples of the electroconductive material (1) may be used.

Further, the example given here uses poly(pyromellitamic acid dimethylester). This material is a precursor for forming the polyamide which is one of the above-mentioned organic materials (2), by the heating processing in the next process.

Other preferable examples of materials which can form polyamides by heating (i.e., precursors) include all-aromatic polyamic acid diesters such as polyamic acid dimethylester comprised of biphenyl tetracarboxylic acid bianhydrides and paraphenylene diamine.

Also, in the case of using polybenzoimidazole as the above organic material (2), all-aromatic polybenzoimidazoles can be suitably used. An example of all-aromatic polybenzoimidazoles is, e.g., 2,2'-(m-phenylene)-5,5'-bibenzoimidazole, or the like.

In the case of using polyamideimide as the above organic material (2), all-aromatic polyamideimides can be suitably used.

Further, in the case of using polyacryllonitrile as the above organic material (2), an solution of polyacryllonitrile dissolved in a medium (solvent) can be suitably used.

Other examples of the above solvent (medium) preferably used include N,N-dimethyl acetoamide, N-methyl-2-pyrolidone, dimethyl sulfoxide.

Thus, this process is a process of applying a liquid (a mixed fluid) comprised of: the above electroconductive material (1) or a precursor to an electroconductive material (e.g., an organic metal compound) which will become the electroconductive material (1) by heating in the next step; and the above organic material (2) or a precursor to an organic material which will become the organic material (2) by heating in the next step; mixed in a solvent. Incidentally, in the event that the ink-jet method is used for the present process, the above mixed fluid serves as the ink.

Also, through the above description involves an example wherein a spinner (rotating deposition) is used as the method of applying the above mixed fluid, but the method of applying the mixed fluid is not restricted to such; rather, the ink-jet method, printing, dispersion application, dipping, or other methods may be used.

Particularly, the ink-jet method is extremely preferable, since the process for patterning the electroconductive organic film can be omitted. Preferable ink-jet methods are: the bubble-jet (BJ) method wherein heat-generating resistor elements are set inside the nozzles, and the heat generated thereby causes the fluid to boil, the pressure thereof ejecting droplets of the fluid; or the piezo-jet (PJ) method wherein electrical signals are applied to piezo device, causing the device to deform, thereby causing excitation in the volume change of the liquid container, thereby ejecting droplets of the fluid; or other such methods, whereby droplets of the above mixed fluid are ejected, consequently applying the droplets of the above mixed fluid at positions where the electroconductive organic film should be formed.

Figure 18A:
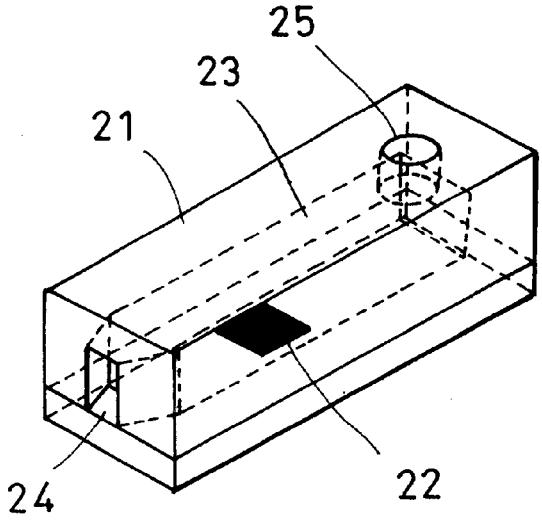
FIGS. 18A–18B are schematic diagrams illustrating an ink-jet head suitably applied to the present invention.
Figure 18B:
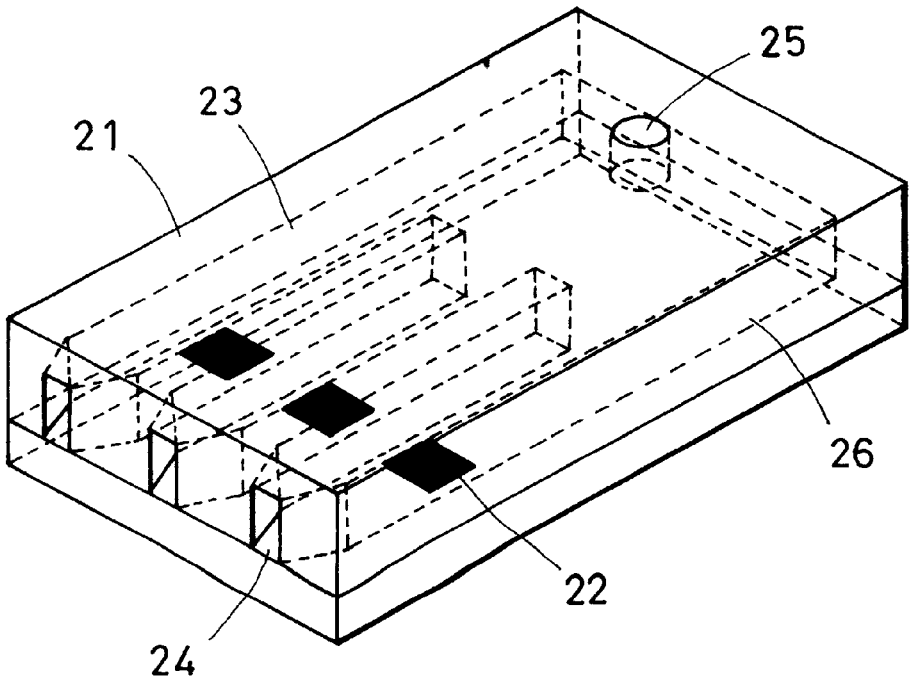

FIGS. 18A–18B are schematic diagrams illustrating an ink-jet head (discharging device) used with the ink-jet method. FIG. 18A illustrates a single-nozzle head 21 which has a single eject nozzle 24. FIG. 18B illustrates a multi-nozzle head 21 which has a multiple eject nozzles 24. Using multi-nozzle heads is particularly preferable, since the amount of time necessary for applying the above mixed fluid onto the substrate can be reduced in the event of forming multiple devices on the substrate. In FIGS. 18A–18B, reference numeral 22 denotes a heater or piezo device, 23 denotes an ink (mixed fluid) channel, 25 denotes an ink (mixed fluid) supplying portion, and 26 denotes an ink (mixed fluid) pool. An ink (mixed fluid) tank is provided at a position removed from the head 21, and the above tank and head 21 are connected at the ink supplying portion 25 via a tube.

Figure 2C:
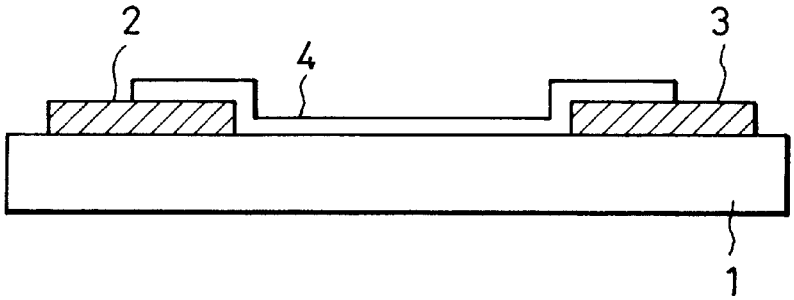

3) Next, the mixed fluid 6 applied onto the substrate 1 is subjected to a heating and baking process, wherein the solvent is evaporated, and also an electroconductive organic film 4 including polyimide and graphite fine particles is formed (FIG. 2C). Incidentally, FIG. 2C indicates the state following patterning. A known method such as lift-off is used for the patterning. Also, using the ink-jet method as described allows patterning to be performed in the same manner as the case wherein the mixed fluid 6 is applied on the substrate as shown in FIG. 2B. According to this process, an electroconductive organic film 4 having $10^3$ to $10^7$ Ω/□ in sheet resistance is formed as described above.

Figure 4:
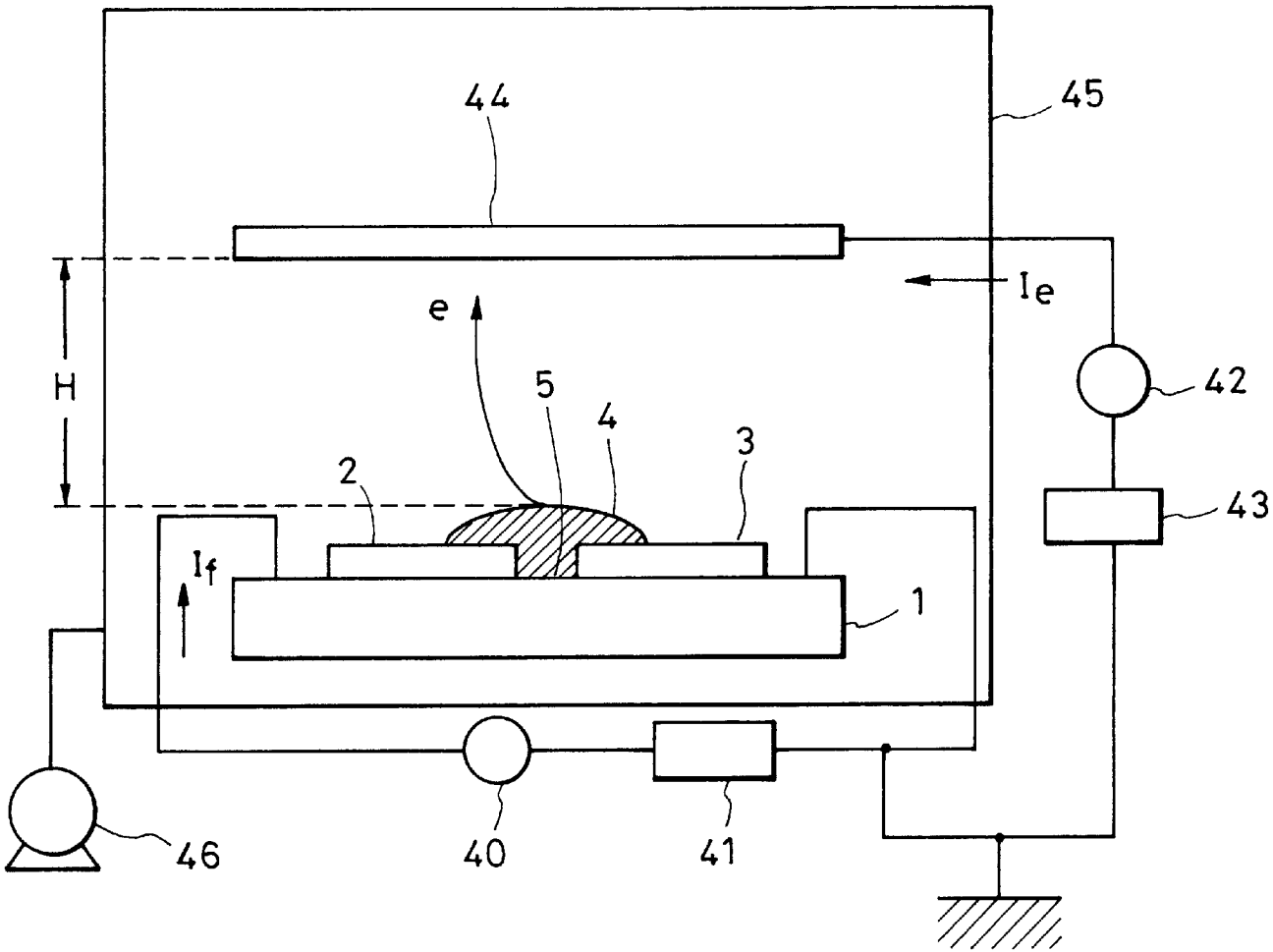
FIG. 4 is a schematic diagram illustrating an example of a vacuum processing apparatus having measurement evaluating functions.

4) Next, the forming process is performed. The method of forming process will now be described. The substrate formed by the above processes 1) through 3) is set in a vacuum processing apparatus such as shown in FIG. 4. Voltage is then applied between the electrodes 2 and 3, in a vacuum of around $10^{-6}$ Pa, for example.

Figure 2D:
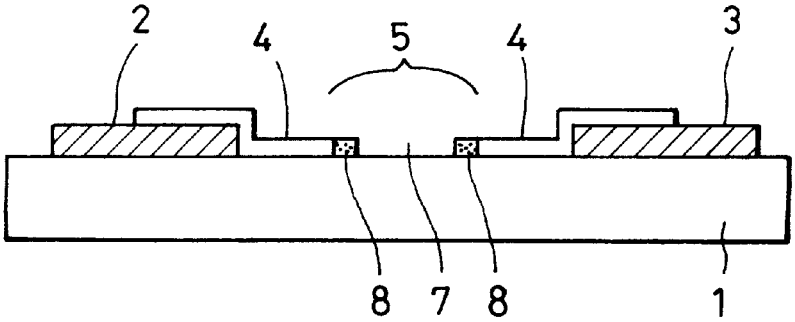

Causing a current to flow through the electroconductive organic film 4, thereby forming an electron emission portion 5 with a changed structure, on a portion of the electroconductive organic film 4 (FIG. 2D). This electrical forming forms a portion on the electroconductive organic film 4 where the structure is locally destroyed, deformed, or altered, this portion comprising the electron emission portion 5. More specifically, a gap is formed at a portion of the electroconductive organic film 4 by this forming process. In further detail, of the organic material (3) comprising the electroconductive organic film 4, the organic material (3) facing the above gap 7 and that near the gap 7 is carbonized, thereby forming a carbonized region 8 comprises graphite and/or amorphous carbon. Also, though the gap 7 is depicted as being the same width and linear in FIGS. 1A–1B and 2D, this is only a schematic representation. The actual form may be such that the gap 7 meanders or changes in width (gap distance) from one portion to another. Also, the form of the above carbonized area 8 may also meander as with the gap, shown in FIG. 1, so this has also been represented schematically.

Also, in FIGS. 1A and 1B, the gap 7 has been schematically depicted as being completely separated from the electroconductive organic film 4 in the width (W) direction of the electrodes 2 and 3. However, depending on the forming conditions and the like, the gap 7 may not be completely separated from the electroconductive organic film 4, and may be partially connected thereto. However, even in the event that there is some partial connection, the portion actually connected is small, so in the present Specification, the term "gap" 7 includes such partially connected areas, as well.

FIGS. 3A–3D illustrate examples of the voltage waveform used for the above forming process.

Figure 3A:
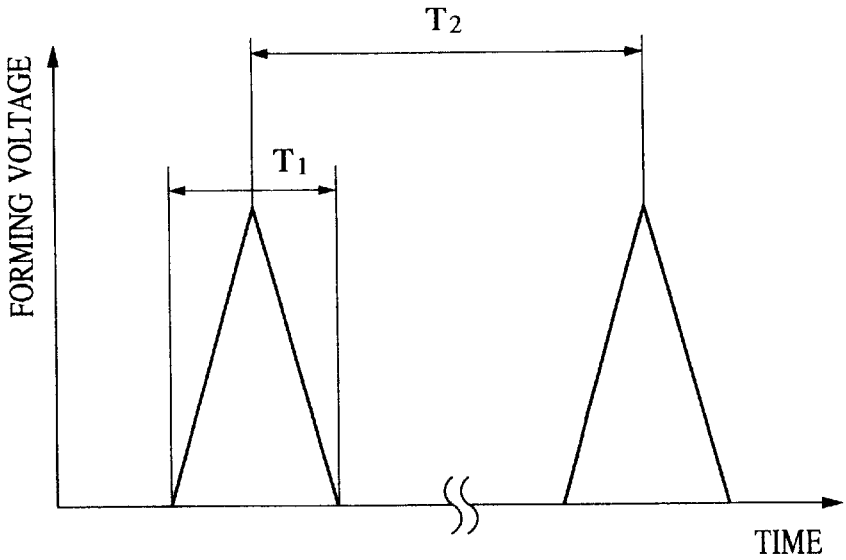
FIGS. 3A–3D are schematic diagrams illustrating an example of the voltage waveform during the electric forming, which can be used for manufacturing a cathode according to the present invention.
Figure 3B:
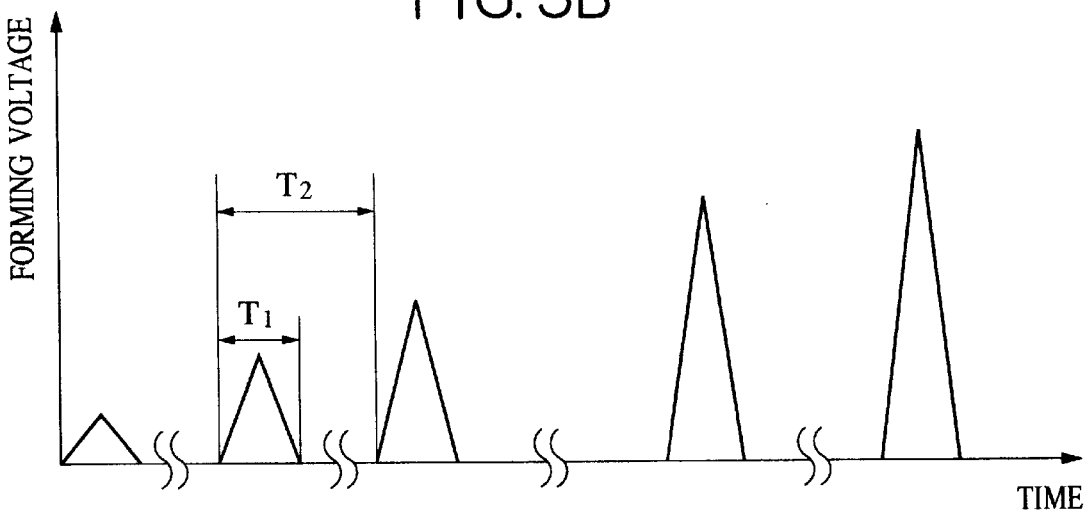
Figure 3C:
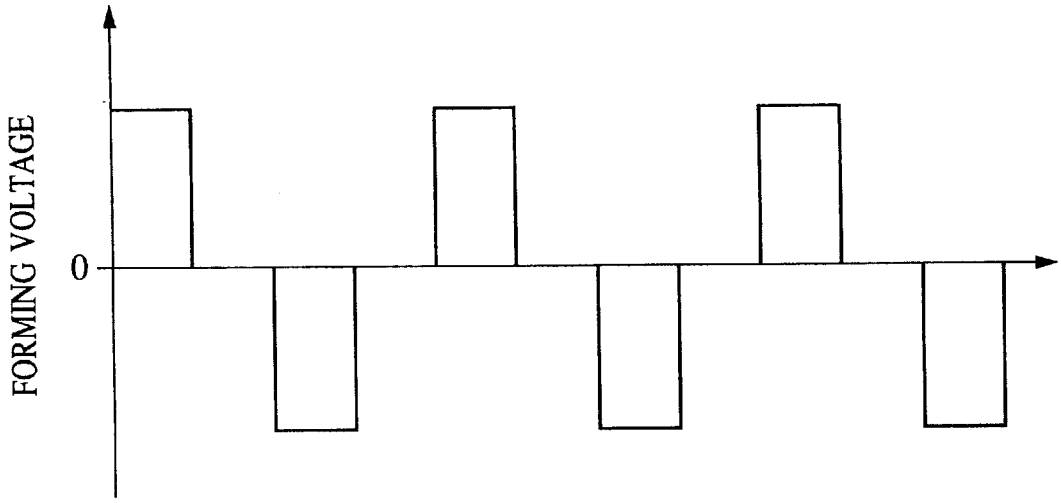
Figure 3D:
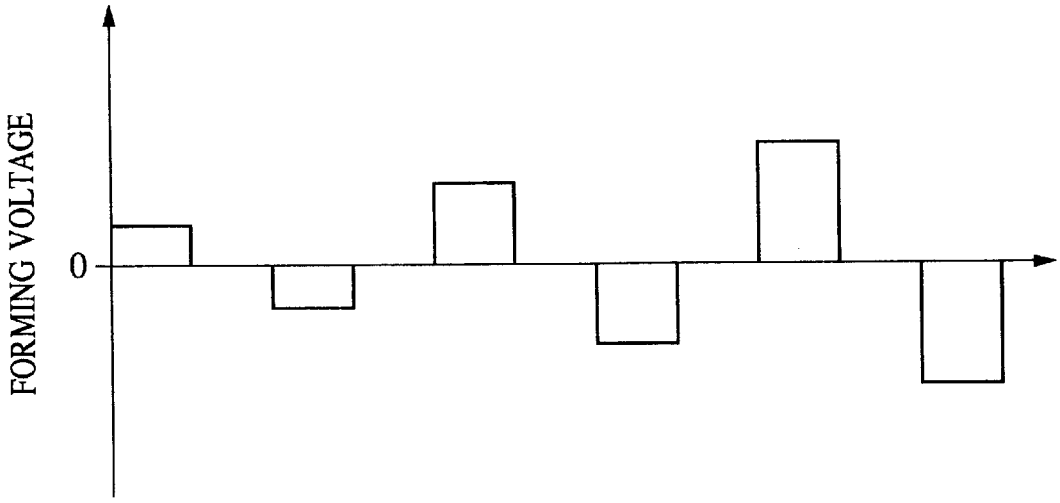

The voltage waveform is preferably a pulse. Generally speaking, there is the method shown in FIGS. 3A and 3C wherein pulses are applied with the pulse peak value as the constant voltage, and the method shown in FIGS. 3B and 3D wherein voltage pulses are applied with the pulse peak value increasing. Though FIGS. 3A–3B show examples of pulses with the same polarity, it is preferable to use bipolar pulses, as shown in FIG. 3C or 3D. Using such bipolar pulses causes the carbonization (becoming graphite or amorphous carbon) to the electroconductive organic film at both side facing the gap 7 to progress at the same degree. Consequently, a device with more stability in electron emission properties can be obtained, as compared with pulse voltage having a single polarity such as shown in FIGS. 3A and 3B.

The pulse width and pulse interval of the voltage waveform is denoted by T1 and T2 in FIG. 3A. Generally, T1 is set within a range of 1 μsec to 10 msec, and T2 is set within a range of 10 μsec to 100 msec. The peak value of a triangular wave (i.e., the peak voltage during forming process) should be appropriately selected according to the form of the device. Under such conditions, voltage is applied for a period of from several seconds to several tens of minutes. The pulse waveform is not restricted to triangular waves; rather, desired waveforms such as rectangular pluses may be used.

The durations T1 and T2 in FIG. 3B may be the same as those shown in FIG. 3A. The peak value of the triangular wave (the peak voltage during electrical forming) may be increased in steps of around 0.1 V, for example.

Completion of the electrical forming can be detected by applying a voltage which is not great enough to locally destroy or deform the electroconductive organic film 4 during the pulse interval T2, and measuring the current. For example, the device current flowing due to voltage application of around 0.1 V is measured the resistance value is calculated, and the electrical forming is completed at the point that the resistance value reaches 1 MΩ or greater.

Figure 16A:
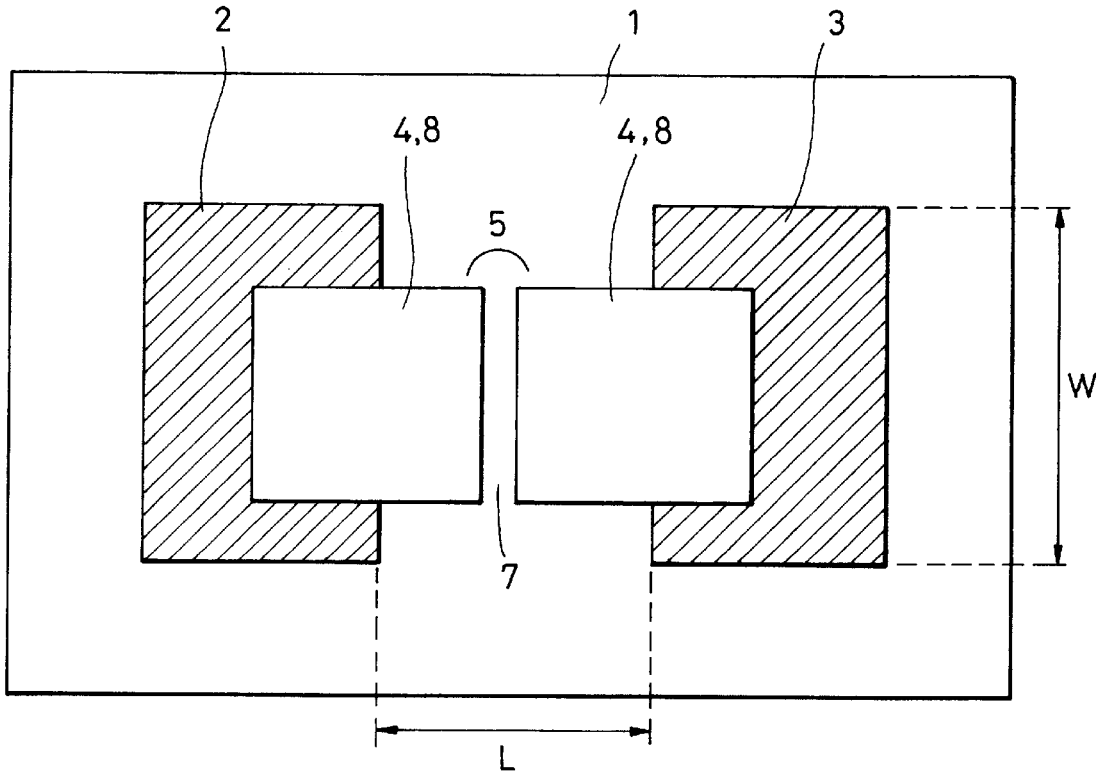
FIGS. 16A–16B are schematic diagrams illustrating the configuration of a cathode according to another example of the present invention.
Figure 16B:
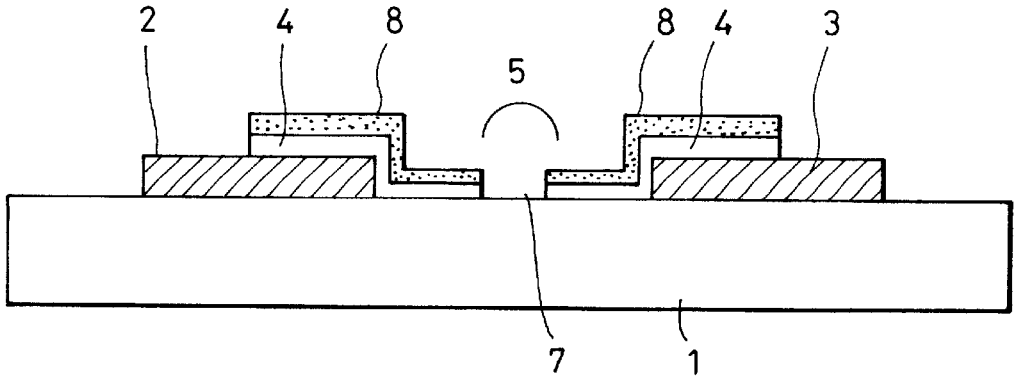
Figure 17A:
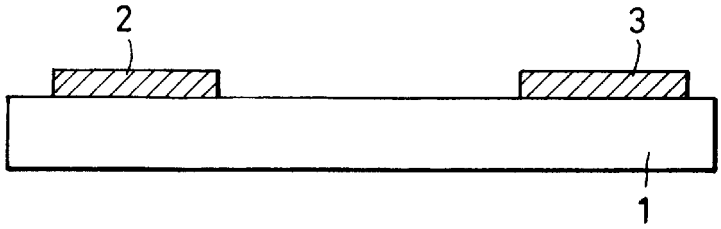
FIGS. 17A–17F are schematic diagrams illustrating the process for fabricating a cathode according to another example of the present invention.
Figure 17B:
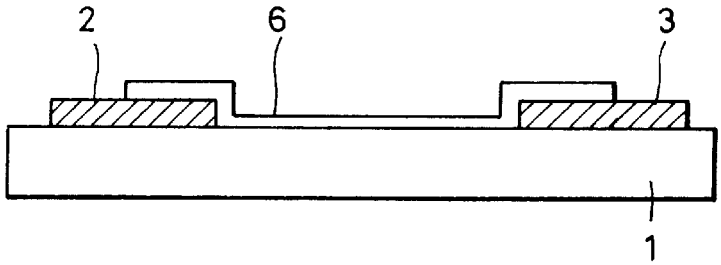
Figure 17C:
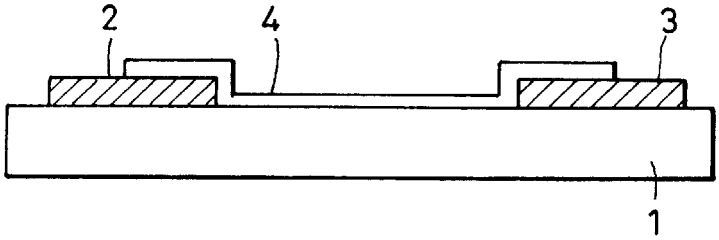
Figure 17D:
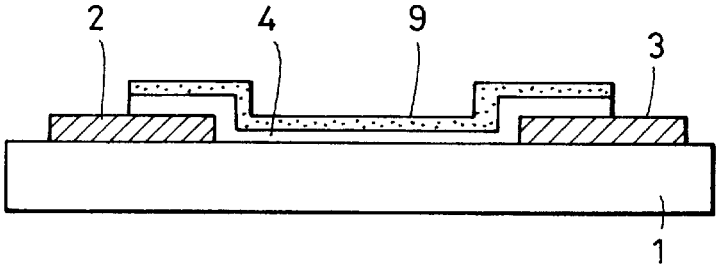

Also, there are cases wherein the present invention preferably has an organic film 8 on the electroconductive organic film 4, as shown in FIGS. 16A–16B. FIG. 16A is a schematic diagram showing a plan view, and 16B is a cross-sectional view of FIG. 16A. An example of a method for manufacturing this device is schematically shown in FIGS. 17A–17F. FIGS. 17A–17C comprise the same process as FIGS. 2A–2C, so description thereof will be omitted here. This method further has the following processes 3') and 3")

between processes 3) and 4) described above. 3') A solution 9 including polymers making up the organic film 8, or a solution 9 including precursors to the polymers making up the organic film 8, is further applied onto the electroconductive organic film 4 formed in the previous process 3) (FIG. 17D). Application of this solution 9 is particularly preferably conducted by the ink-jet method. When using the ink-jet method for application thereof, it is further preferable to apply this so as to have the same diameter as the electroconductive organic film 4 created beforehand, in particular. Even more preferable is conducting application such that a film of the solution 9 is formed at a diameter smaller than the diameter of the electroconductive organic film 4 created beforehand, so that the required alignment precision regarding the electroconductive organic film 4 formed beforehand can be reduced. In the event that the application is carried out in such a manner, the diameter of the organic film 9 is smaller than the diameter of the electroconductive organic film 8.

It is preferable that the above polymers be either one of the organic materials (3) listed above, or a precursor thereof which becomes the organic material (3) due to the heating process in the subsequent step 3"). Specifically, it is preferable that the organic material included in the electroconductive organic film 4 and the organic material constituting the organic film 8 both be all-aromatic polyimides.

Figure 17E:
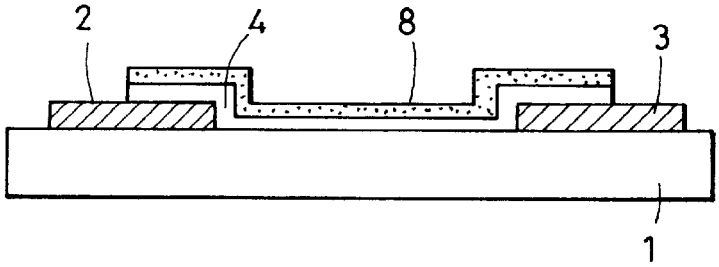

3") the solution applied in the previous process 3') is heated and baked so as to evaporate the solvent, thereby forming an organic film (heat-resistant polymer film) 8 upon the electroconductive organic film 4 (FIG. 17E).

Then, as necessary, patterning of the above heat-resistant polymers is performed. Performing the above application in process 3') by the above-described ink-jet method is preferable, since this patterning process can be omitted. Also, in the event that a solution including precursors to the heat-resistant polymer is used in the process 3'), this process evaporates the solvent and also changes the precursors into the heat-resistant polymers.

Figure 17F:
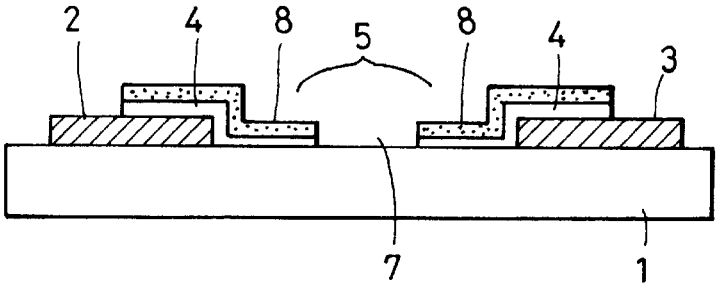

The subsequent process is the same as the above-described process 4). Causing a current flow through the electroconductive organic film 4 in process 4) not only forms the gap 7 in the electroconductive organic film 4, but also in the heat-resistant polymer film 8 (FIG. 17F). Further, in the same manner as with the above formation of the gap 7, the portion of the heat-resistant polymer film (organic film) 8 facing the gap 7 and the portion of the electroconductive organic film 4 facing the gap 7 are carbonized. Here, the term "carbonized" refers to becoming graphite and/or amorphous carbon. Covering the electroconductive organic film 4 formed by the above processes 2) and 3) with heat-resistant polymers such as polyimide in the processes 3') and 3") improves the heat-resistance of the electroconductive organic film. Also, in order to perform the forming process, the electroconductive organic film 4 must have the above-described electroconductivity. Accordingly, depending on conditions, sufficient conversion to graphite and/or amorphous carbon for obtaining excellent electron emission properties cannot be obtained in the above forming process. In such cases, the degree of carbonization is preferably controlled by forming a layer of organic film such as shown in FIGS. 16A–16B.

<Cathode properties>

FIG. 4 is a schematic diagram illustrating an example of a vacuum processing apparatus, which also serves as a measurement evaluating device. In FIG. 4, reference numeral 1 schematically denotes an insulating substrate, 2 and 3 denote electrodes, 4 denotes an electroconductive organic film, and 5 denotes an electron emission portion. Further, 41 denotes a power source for applying voltage to the device, 40 is an ammeter for measuring the device current If, 44 is an anode electrode of measuring the emission current Ie generated by the device, 43 is a high-voltage power source for applying voltage to the anode electrode 44, and 42 is an ammeter for measuring the emission current. For measuring the device current If and the emission current Ie, the power source 41 and ammeter 40 are connected to the electrodes 2 and 3, and the anode electrode 44 to which the power source 43 and the ammeter 42 have been connected is positioned above the cathode. Also, the cathode and the anode electrode 44 are positioned within the vacuum apparatus 45, with an vacuum pump 46 and unshown vacuum meter being provided thereto, so that the measurement and evaluation of the device can be performed under a desired vacuum. Incidentally, with the present example, the distance between the anode electrode and cathode was set at 4 mm, the potential of the anode electrode at 1 kV, and the pressure within the vacuum apparatus at the time of measuring electron emission properties at $1.3\times10^{-4}$ Pa.

Figure 5:
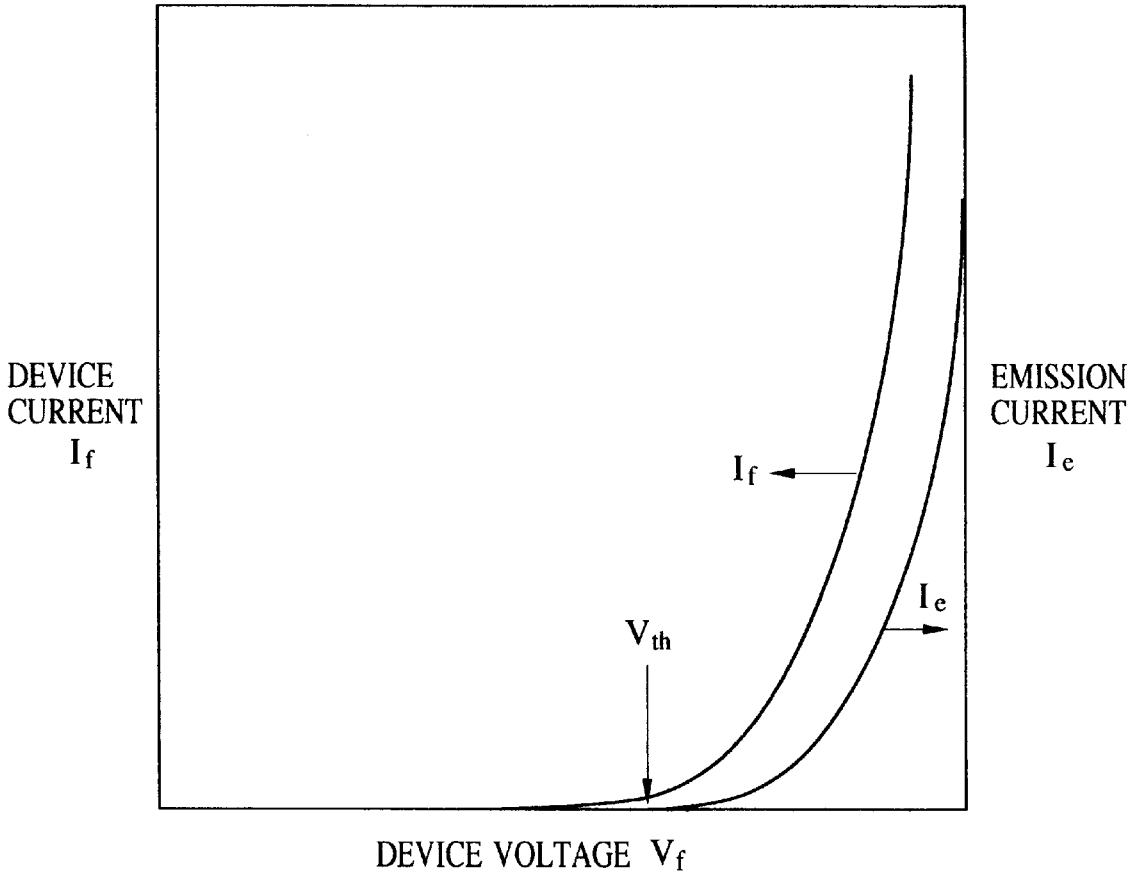
FIG. 5 is a graph illustrating an example of the relationship between the emission current Ie, element current If, and element voltage Vf, of the cathode according to the present invention.

The cathode according to the present invention has electron emission properties such as schematically shown in FIG. 5. The electron emission properties can be controlled by the pulse peak value and width of the pulse voltage applied between the opposing electrodes 2 and 3, at the threshold voltage (Vth) or higher. On the other hand, almost no electrons are emitted below the threshold voltage. According to these properties, even in cases wherein a great number of cathodes are arrayed, appropriate application of the pulse voltage to each device causes the cathodes according to the present invention to be selected according to input signals, thereby controlling the amount of electron emission.

Various arrangements may be employed regarding the cathode array. One example is a ladder-shaped array wherein a great number of cathodes arrayed in a parallel manner are connected at each end, a great number of cathode rows are arrayed (referred to as the "row direction"), control electrodes are positioned above the cathodes in a direction orthogonal to the wiring thereof (referred to as "column direction"), thereby forming what is known as a "grid", wherein controlled driving is performed regarding the electrons from the cathodes.

Another arrangement is to array a plurality of cathodes in the X-direction and Y-direction in a matrix form, wherein one of the electrodes of each of the multiple cathodes arrayed in the same row are connected to a common wire in the X-direction, and the other electrode of each of the multiple cathodes arrayed in the same row are connected to a common wire in the Y-direction. This arrangement is called a simple matrix array. First, this simple matrix array will be described in detail below.

<Electron source substrate>

Figure 6:
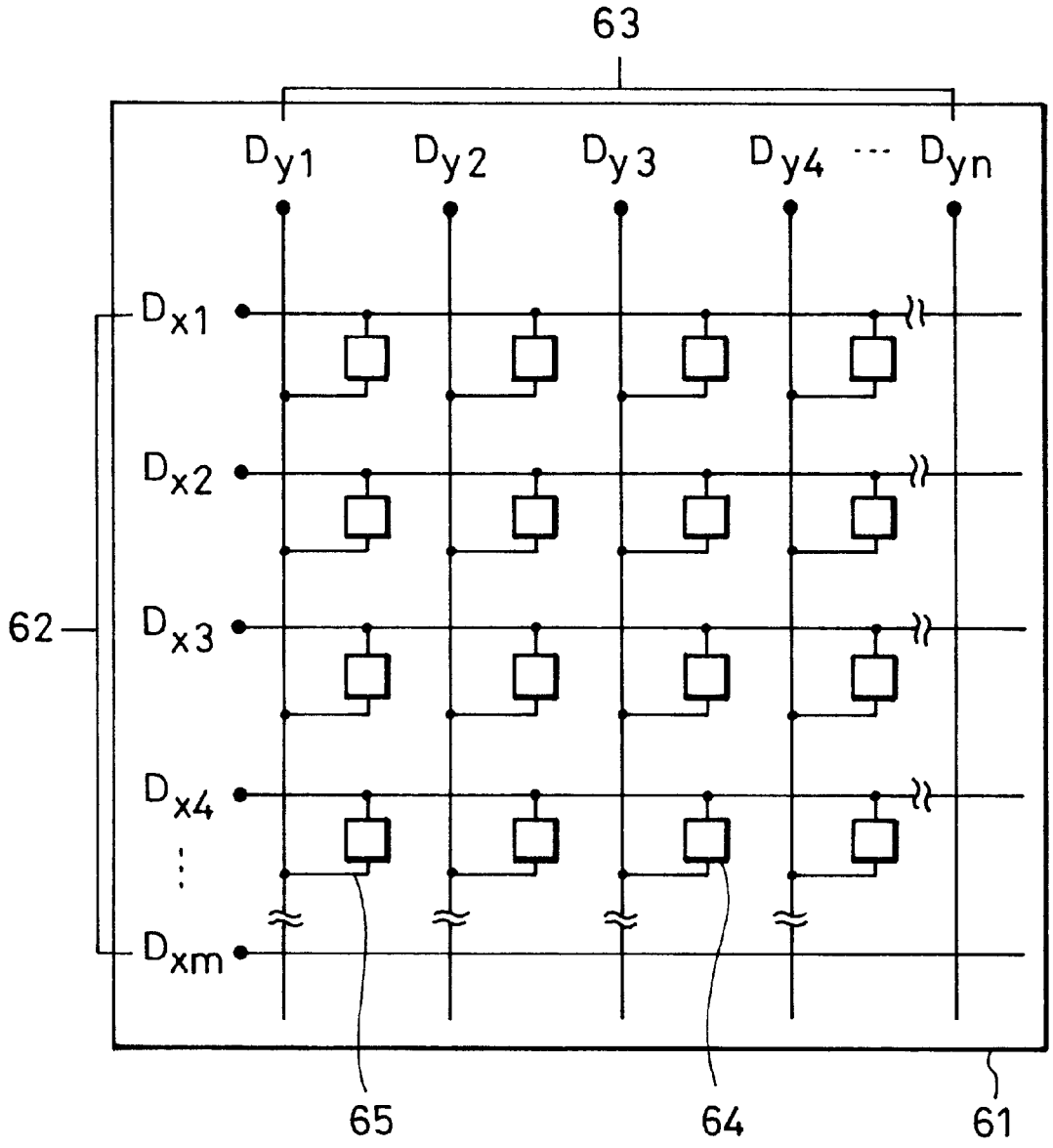
FIG. 6 is a schematic diagram illustrating an example of a the display panel of a simple matrix array electron source which can be used for the present invention.

An electron source substrate obtained by arraying a plurality of cathodes according to the invention based on this principle will be described with reference to FIG. 6. In FIG. 6, reference numeral 61 denotes an electron source substrate, 62 denotes X-directional wires, and 63 denotes Y-directional wires. Reference numeral 64 denotes the cathodes according to the present invention, and 65 denotes connections connecting to the Y-directional wires 63.

There are an m number of the X-directional wires 62 $Dx_1$, $Dx_2$, and so on through $Dx_m$, and these may be formed of an electroconductive metal or the like using vacuum vapor deposition, printing, sputtering, or the like. The material, thickness, and width of the wires should be designed as appropriate for the use. There are an n number of the Y-directional wires 63 $Dy_1$, $Dy_2$, and so on through $Dy_n$, formed in the same manner as the X-directional wires 62. An unshown insulating layer is provided between the m number of X-directional wires 62 and the n number of Y-directional wires 63, separating the two electrically. Incidentally, it should be noted that in the above description, m and n both are positive integers.

The above X-directional wires, Y-directional wires, and insulating layer are preferably formed by printing method. More preferably is forming these by screen printing method, which is suitable for forming such structures over a wide area at low costs.

The unshown insulating layer is formed from $SiO_2$ or the like formed by vacuum vapor deposition, printing, sputtering, or the like. For example, the insulating layer is formed in a desired shape over all or part of the area of the substrate 61 on which the X-directional wires 62 are formed, and the thickness, material, and manufacturing method thereof is appropriately set so as to be able to withstand the potential difference at the intersections between the X-directional wires 62 and Y-directional wires 63, in particular. The X-directional wires 62 and Y-directional wires 63 are each extracted as external terminals.

The pair of electrodes (not shown) comprising the cathode 64 according to the present invention, an m number of X-directional wires 62, an n number of Y-directional wires 63, and connecting lines 65 formed of an electroconductive metal or the like, are electrically connected.

Part or all of the component elements making up the material making comprising the X-directional wires 62 and Y-directional wires 63, the material comprising the connecting lines 65, and the material comprising the pair of electrodes 2 and 3 may be the same, or all may be different. These materials are appropriately selected from the above-described materials for the electrodes 2 and 3. In the event that the material comprising the electrodes and the material comprising the wires are the same material, the wires coming into contact with the electrodes themselves also may be described as electrodes.

Scanning signal applying means, not shown in the drawings, are connected to the X-directional wires 62, for applying scanning signals for selecting the line of cathodes 64 arrayed in the X-direction. On the other hand, modulating signal generating means, not shown in the drawings either, are connected to the y-directional wires 63, for modulating each column of cathodes 64 arrayed in the Y-direction according to input signals. The driving voltage applied to each for the cathodes is supplied as the difference voltage of the scanning signals and modulating signals applied to the devices.

With the above configuration, a simple matrix wiring arrangement can be used to select individual devices, and individually drive each.

<Display panel>

Figure 7:
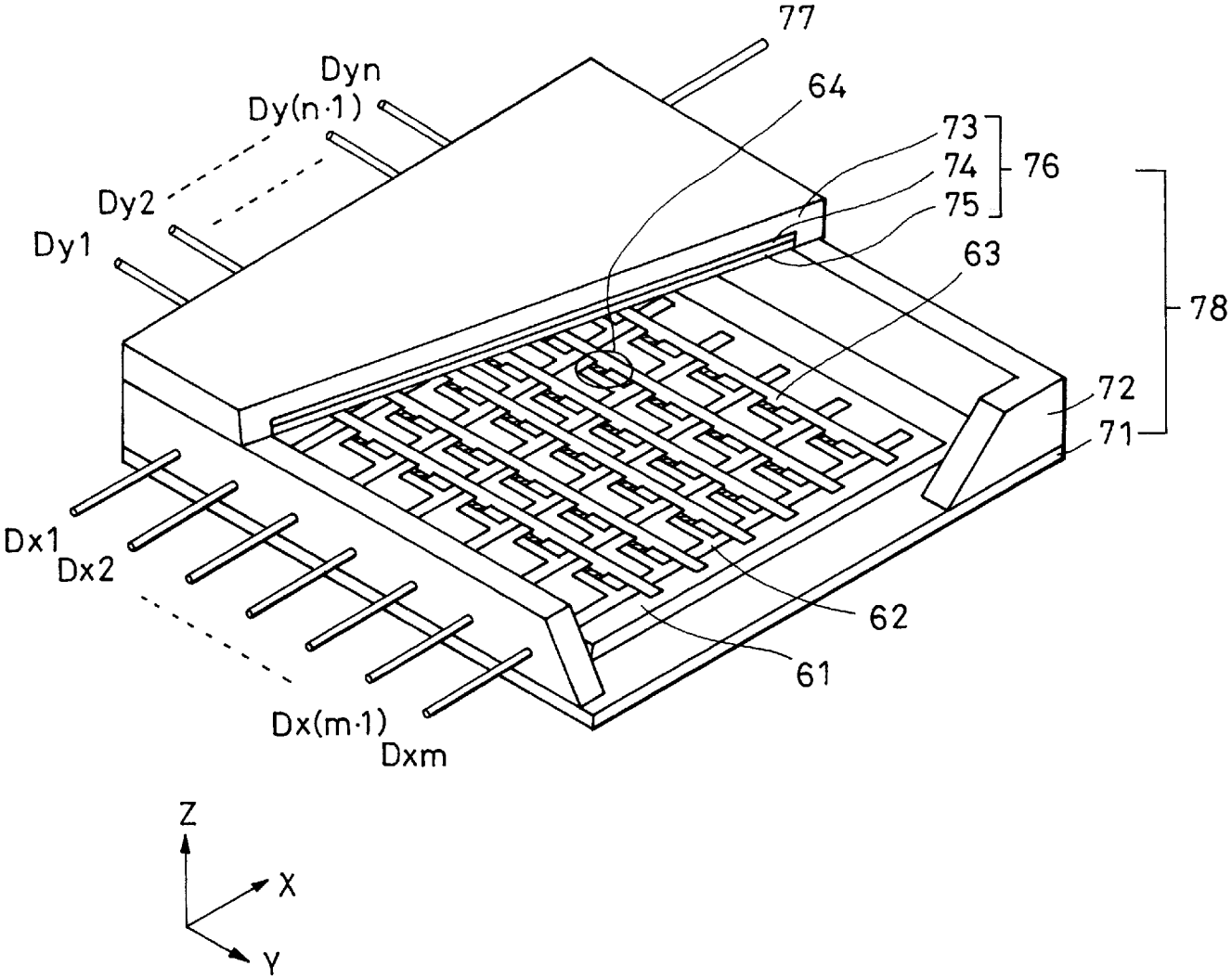
FIG. 7 is a schematic diagram illustrating an example of a simple matrix array image forming apparatus which can be used for the present invention.
Figure 8A:
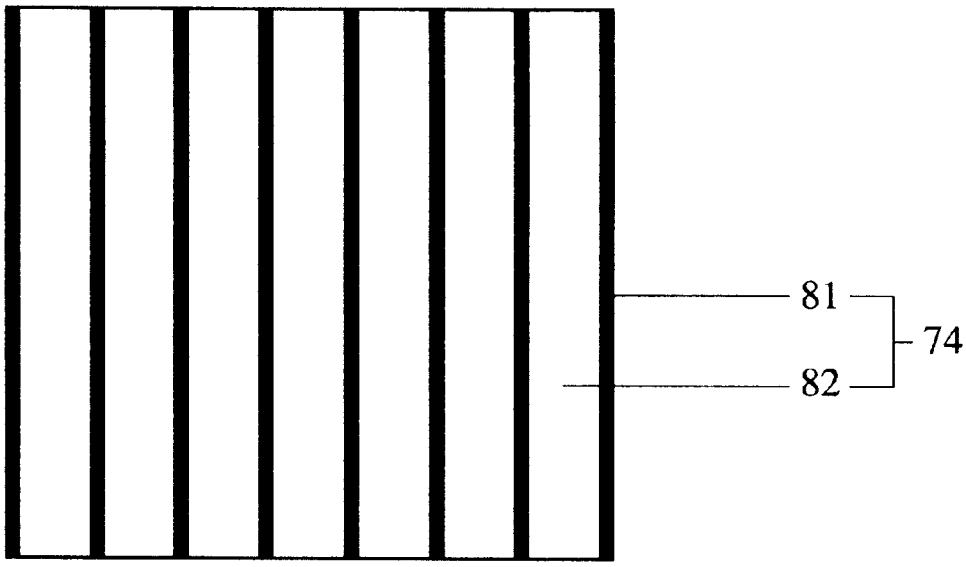
FIGS. 8A–8B are schematic diagrams illustrating an example of a fluorescent film.
Figure 8B:
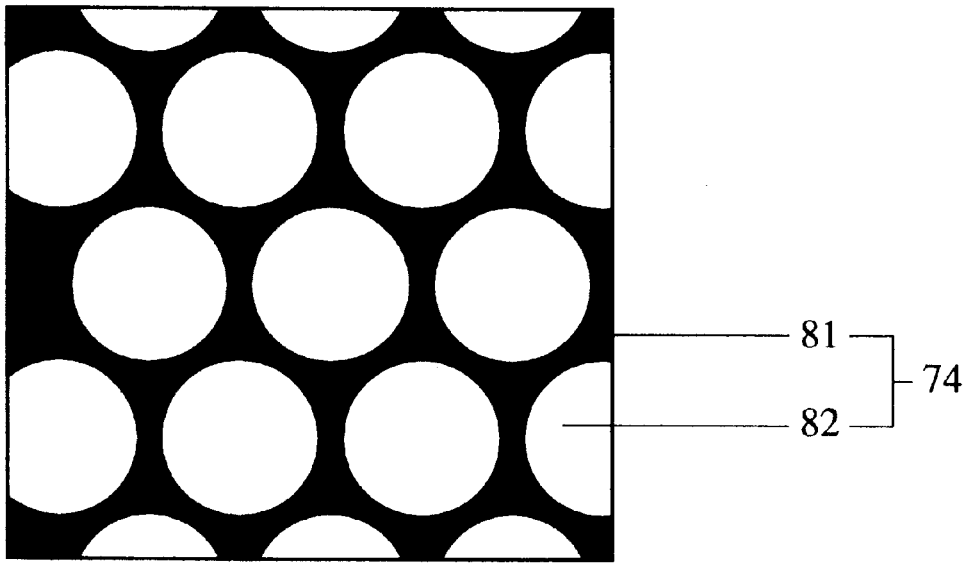
Figure 9:
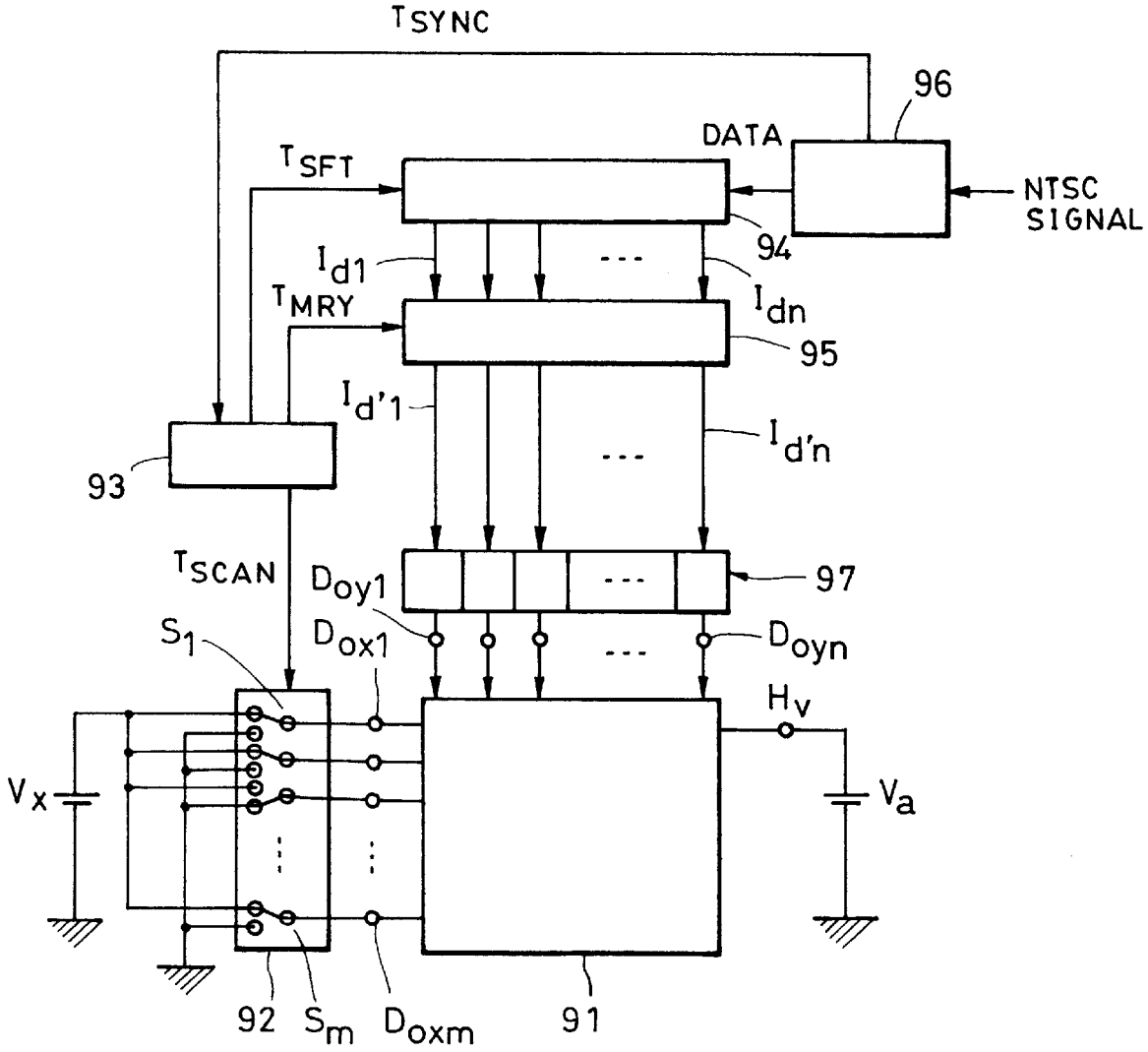
FIG. 9 is a block diagram illustrating an example of a driving circuit for displaying images on an image forming apparatus according to NTSC television signals.

An image forming apparatus constructed using such an electron source comprised of a simple matrix array will now be described with reference to FIGS. 7 through 9. FIG. 7 is a schematic diagram illustrating an example of a display panel of an image forming apparatus, FIGS. 8A–8B are schematic diagrams illustrating an example of a fluorescent film used in the image forming apparatus shown in FIG. 7, and FIG. 9 is a block diagram illustrating an example of a driving circuit for displaying images on an image forming apparatus according to NTSC television signals.

In FIG. 7, reference numeral 61 denotes an electron source substrate whereupon a plurality of cathodes according to the present invention are arrayed, 71 denotes a rear plate for fixing the electron source substrate 61, and 76 denotes a face plate wherein a fluorescent film 74, metal backing 75, and the like are formed on the inner side of a glass substrate 73. Reference numeral 72 a supporting frame, with the rear plate 71 and face plate 76 being connected to the supporting frame 72 using frit glass or the like of an adhesive agent. Reference numeral 78 denotes an envelope which is sealed and constructed by baking for 10 minutes or more in an ambient atmosphere or in nitrogen at temperatures within a range of 400 to 500° C. The face plate 76 is constructed of a fluorescent film 74 and metal backing 75 below a glass substrate 73 formed of glass or the like.

Also, the cathode 64 is equivalent to the cathode according to the present invention. Reference numerals 62 and 63 are the X-directional wires and Y-directional wires connected to the pair of electrodes of the cathode according to the present invention.

The envelope 78 is, as described above, comprised of a face plate 76, supporting frame 72, and rear plate 71. The rear plate 71 is mainly provided to supplement the strength of the substrate 61, so in the event that substrate 61 itself has sufficient strength, a separate rear plate 71 may be omitted. That is, an arrangement may be used wherein the supporting frame 72 is directly sealed to the substrate 61, thus comprising the envelope 78 of the face plate 76, supporting frame 72, and substrate 61. On the other hand, an envelope 78 with sufficient strength regarding atmospheric pressure can be configured by providing an unshown supporting member called a spacer between the face plate 76 and rear plate 71.

FIG. 8 is a diagram illustrating the fluorescent film 74. The fluorescent film 74 can be comprised of a fluorescent member alone in the event of manufacturing a monochrome device. In the case of a color fluorescent film, the fluorescent film 74 can be formed of a black member 81 called black-stripe, black-matrix, or some other like name, and fluorescent members 82 for each color. An object of providing the black-stripe or black-matrix is to subdue color mixing that occurs between each of the fluorescent members 82 for the three basic colors that become necessary for color display, by coloring black between each of the fluorescent members 82. Another object is to suppress deterioration in contrast due to reflection of external light at the fluorescent film 74. Regarding the material for the black-stripe or black-matrix, commonly-used materials comprised mainly of black lead or other materials with little transmittance or reflection of light may be used.

Sedimentation, printing, etc. can be used as methods for applying the fluorescent material to the glass substrate 73, regardless of monochrome or color. Generally, a metal backing 75 is provided to the inner side of the fluorescent film 74. The object of providing this metal backing is to improve brightness by mirror-like reflecting of the light emitted inwards from the fluorescent member toward the face plate 76 side, and to serve as an electrode for applying the electron beam acceleration voltage, and also to protect the fluorescent member from damage due to collision of negative ions generated within the encasement, and so forth. The metal backing can be manufactured by performing a smoothing process (commonly referred to as "filming") on the inner side surface of the fluorescent film following fabricating the fluorescent film, and then depositing aluminum using vacuum vapor deposition or the like while maintaining transparency.

Regarding the face plate 76, transparent electrodes (not shown) of ITO or the like may be provided to the outer side of the fluorescent film 74, to further improve the electroconductivity thereof.

At the time of performing the above sealing, there is the need with color devices to correlate the fluorescent members for each color with the cathodes, and sufficient positioning is indispensable.

The image forming apparatus shown in FIG. 7 is manufactured as described below, for example.

First, properties checking is performed for each of the cathodes (electron-emitting devices) on the electron source substrate 61 upon which a great number of cathodes are arrayed, the above-described forming process having been completed. The properties checking is performed in a vacuum which is around the same as the atmosphere in which the forming was performed, or a greater vacuum. An example of a specific check is to apply voltage to each device, and check the device current If flowing between the electrodes 2 and 3. Or, the emission current Ie being emitted form the device may be checked. At the same time, a check is performed for determining whether are not there are any pixel dropouts on the face plate. In the event that the check shows no defects to be present, the electron source substrate 61, face plate 76, and supporting frame 72 are assembled, and bonded as described above. Next, the interior of the envelope 78 is reduced to a pressure of around $1.3\times10^{-5}$ Pa by means of a vacuum pump via an unshown exhausting tube, following which the exhausting tube is tipped off (sealing process). In order to maintain the pressure following tipping off the envelope 78, getter processing may be performed as well. This is a process which involves using resistance heat, high-frequency heat, etc., to heat a getter positioned at a certain location (not shown) within the envelope 78, either immediately before sealing or after sealing, thereby forming an evaporation deposition film. The getter commonly has Ba or the like as the main component thereof, and maintains the pressure by the adhesion effects of this evaporation deposition film.

<Method of driving the display panel>

Next, an example of configuring a driving circuit for performing television display on the display panel configured using the simple matrix array electron source, based on NTSC television signals, will be described with reference to FIG. 9. In FIG. 9, reference numeral 91 denotes an image display panel, 92 denotes a scanning circuit, 93 denotes a control circuit, and 94 denotes a shift register. Reference numeral 95 denotes a line memory, 96 denotes a synchronizing signal dividing circuit, 97 denotes a modulation signal generating circuit, and Vx and Va represent DC voltage sources.

The display panel 91 is connected to the external electrical circuits via terminals $Dox_1$ through $Dox_m$, terminals $Doy_1$ through $Doy_n$, and high voltage terminal Hv. Scanning signals for sequentially driving the electron sources provided within the display panel, i.e., the surface conduction type cathode group in an M-row N-column matrix array, one row (N elements) at a time, are applied to the terminals $Dox_1$ through $Dox_m$.

Applied to the terminals $Doy_1$ through $Doy_n$ are modulation signals for controlling the output electron beam of each of the cathodes in the row selected by the scanning signals. A DC voltage of 10 kV, for example, is applied from the DC power source Va to the high-voltage terminal Hv, this being an acceleration voltage for providing sufficient energy to the electron beams emitted from the cathodes, to cause excitation of the fluorescent members.

The scanning circuit 92 will now be described. The scanning circuit 92 comprises an M number of switching devices provided therein (schematically represented in the drawings as $S_1$ through $S_m$). Each switching device selects either the output voltage of the DC voltage source Vx or zero V (ground level), and is electrically connected to the terminals $Dox_1$ through $Dox_m$ on the display panel 91. The switching devices $S_1$ through $S_m$ operate on control signals Tscan output from the control circuit 93, and can be configured by assembling switching devices such as FETs.

In this arrangement, the DC voltage source Vx is set so as to output a constant voltage such that the driving voltage applied to elements not scanned based on the properties of the cathodes (i.e., electron discharge threshold voltage) is the same level as the electron discharge threshold voltage or lower.

The control circuit 93 has functions for rectifying the operation of each unit so that appropriate display is performed based on externally-input image signals. The control circuit 93 generates the Tscan and Tmry control signals for each unit based on the synchronizing signals Tsync, sent from the synchronizing signal dividing circuit 96.

The synchronizing signal dividing circuit 96 is a circuit for separating synchronizing signal component and the brightness signal component from the NTSC television signals externally input. This can be configured using common frequency (filter) circuits or the like. The synchronizing signals separated by the synchronizing signal dividing circuit 96 are comprised of vertical synchronizing signals and horizontal synchronizing signals, but the synchronizing signals have been represented simply as Tsync signals here, for facilitating simplicity in the description. For the same reason, the image brightness signals separated form the television signals have been represented as DATA signals. The DATA signals are input to the shift register 94.

This shift register 94 is for performing serial/parallel conversion for each image line of the DATA signals serially input in time-sequence, and operates based on the control signals Tsft sent from the control circuit 93 (i.e., it can be said that the control signals Tsft are the shift clock of the shift register 94). The data of one image line (equivalent to the driving data for and N number of cathodes) which has been subjected to serial/parallel conversion is output from the shift register 94 as an N number of parallel signals, $Id_1$ through $Id_n$.

The line memory 95 is a storage device for storing one line of image data for a certain amount of required time only, and thus stores the contents of $Id_1$ through $Id_n$ as appropriate, based on the control signals Tmry sent from the control circuit 93. The stored contents are output as $I'd_1$ through $I'd_n$, and input to the modulation signal generator 97.

The modulation signal generator 97 is a signal source for performing appropriate driving modulation of the surface conduction type cathodes, according to each of the pieces of image data $I'd_1$ through $I'd_n$, and the output signals thereof are applied to the surface conduction type cathodes within the display panel 91 through the terminals $Doy_1$ through $Doy_n$.

As described above, the cathodes to which the present invention is applicable have the following basic properties regarding the emission current Ie. That is, there is a clear threshold voltage Vth for electron emission, and electron emission only occurs in the event that a voltage of Vth or greater is applied. At voltages of the electron emission threshold or greater, the emission current changes according to change in the voltage applied to the elements.

Thus, in the event of applying voltage in the form of pulses to the elements, applying a voltage smaller than the electron emission threshold (Vth) for example causes no electron emission, but applying a voltage equal to or greater than the electron emission threshold (Vth) for example causes an electron beam to be output. At this time, the intensity of the output electron beam can be controlled by means of changing the peak value Vm of the pulses. Also, the total volume of the charge of the output electron beam can be controlled by changing the pulse width Pw.

Accordingly, voltage modulation and pulse width modulation are methods which can be employed as methods for modulating the cathodes according to input signals. In the event of executing the voltage modulation method, a voltage modulating circuit, which generates voltage pulses of a constant length, and modulates the peak value of the pulses as appropriate according to the input data, can be used as the modulation signal generator 97.

In the event of executing the pulse width modulation method, a pulse width modulating circuit, which generates voltage pulses of a constant height, and modulates the width of the pulses as appropriate according to the input data, can be used as the modulation signal generator 97.

The shift register 94 and line memory 95 may either be designed for digital signals or analog signals. All that is required thereof is that serial/parallel conversion and storage of the image signals be performed at the stipulated speed.

In the case of using digital signal types, there is the need to digitize the output signals DATA from the synchronizing signal dividing circuit 96, but this can be achieved by providing an A/D converter at the output of the synchronizing signal dividing circuit 96. In related matters, the circuit used for the modulation signal generator 97 differs somewhat depending on whether the output signals from the line memory 95 are digital signals or analog signals. That is, in the event of performing voltage modulation using digital signals, a D/A conversion circuit for example is used for the modulation signal generator 97, with amplification citrates or the like being added as necessary. In the event of the pulse width modulating method, the circuit used for the modulation signal generator 97 is comprised of a combination of a high-speed oscillator and a counter for counting the number of waves output from the high-speed oscillators, and a comparator for comparing the output value of the counter with the output value of the memory. If necessary, an amplifier for amplifying the voltage of the pulse-width modulated signals output from the comparator to the voltage for driving the surface conduction type cathodes, may be provided.

In the case of voltage modulation using analog signals, an amplifier circuit using an operational amp may be employed for the modulation signal generator 97, with a level shifting circuit added if necessary. In the case of pulse width modulation, a voltage control oscillating circuit (VCO) can be used for example, with an amplifier for amplifying the voltage of the pulse-width modulated signals to the voltage for driving the surface conduction type cathodes.

With an image display apparatus to which the present invention is applicable and which can have such a configuration, electron emission is generated by applying voltage to each of the cathodes via the terminals $Dox_1$ through $Dox_m$ and terminals $Doy_1$ through $Doy_n$ that are outside of the encasement. A high voltage is applied to the metal backing 75 or transparent electrode (not shown) via the high-voltage terminal Hv, thereby accelerating the electron beam. The accelerated electrons collide with the fluorescent film 84, generating light and thereby forming an image.

It should be noted that the configuration of the image forming apparatus described here is only an example of an image forming apparatus to which the present invention is applicable, and that various alterations can be made based on the technological idea of the present invention. While NTSC signals have been described as the input signals, the present invention is by no means restricted to such; rather, various other types may be used with the present invention, such as PAL SACAM, and further, television signals with even greater numbers of scanning lines (e.g., high-definition television such as MUSE) may be employed, as well.

<Ladder-array electron source and image forming apparatus>

Next, the ladder-array electron source and image forming apparatus will be described with reference to FIG. 10 and FIG. 11.

Figure 10:
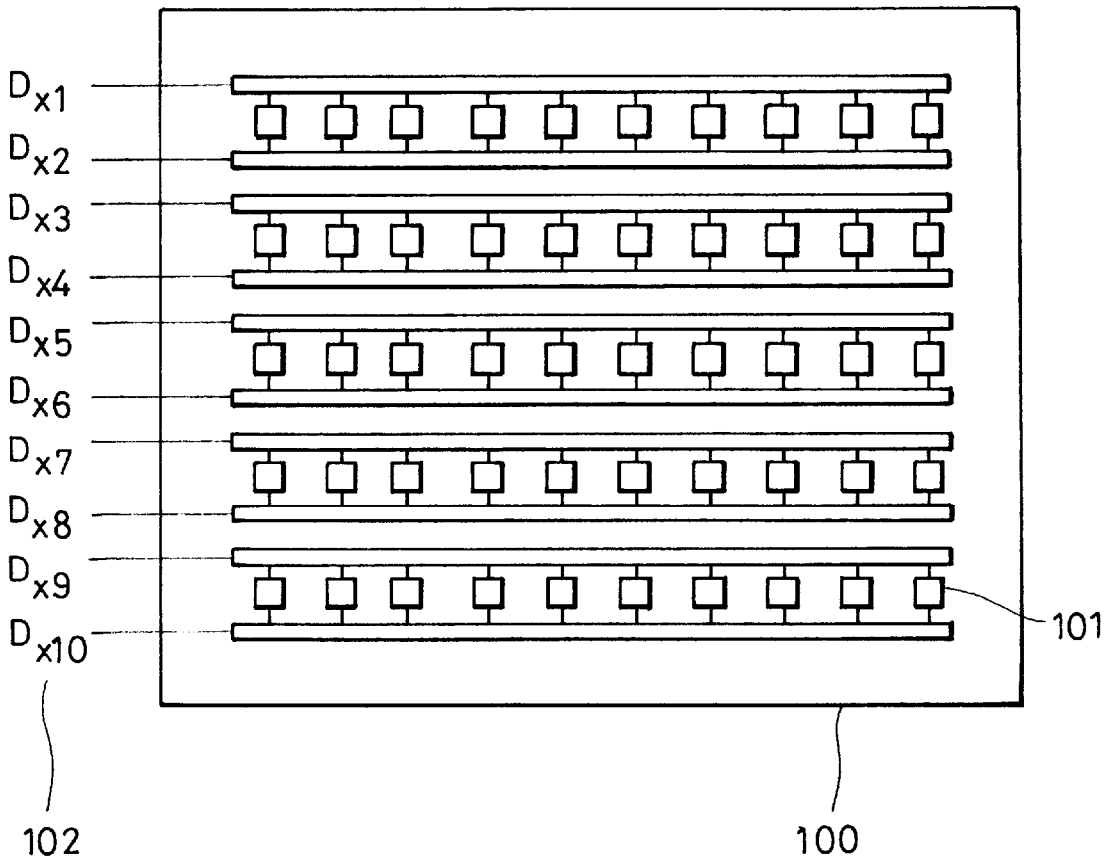
FIG. 10 is a schematic diagram illustrating an example of a ladder-array electron source applicable to the present invention.

FIG. 10 is a schematic diagram illustrating an example of a ladder-array electron source. In FIG. 10, reference numeral 100 denotes an electron source substrate, and 101 denotes cathodes. $Dx_1$ through $Dx_{10}$ denoted by reference numeral 102 are common wires for connecting the cathodes 101. Multiple cathodes 101 are arrayed on the electron source substrate 100 in a parallel manner in the X-direction (referred to as "device line"), thereby forming the electron source. Applying driving voltage between the common wires for each device line allows each device line to be driven independently. That is, a voltage equal to or greater than the electron emission threshold voltage is applied to the device lines from which emission of electron beams is desired, and a voltage smaller than the electron emission threshold voltage is applied to the device lines from which emission of electron beams is not desired. With regard to the common wires $Dx_2$ through $Dx_9$, $Dx_2$ and $Dx_3$ might share a single wire, for example.

Figure 11:
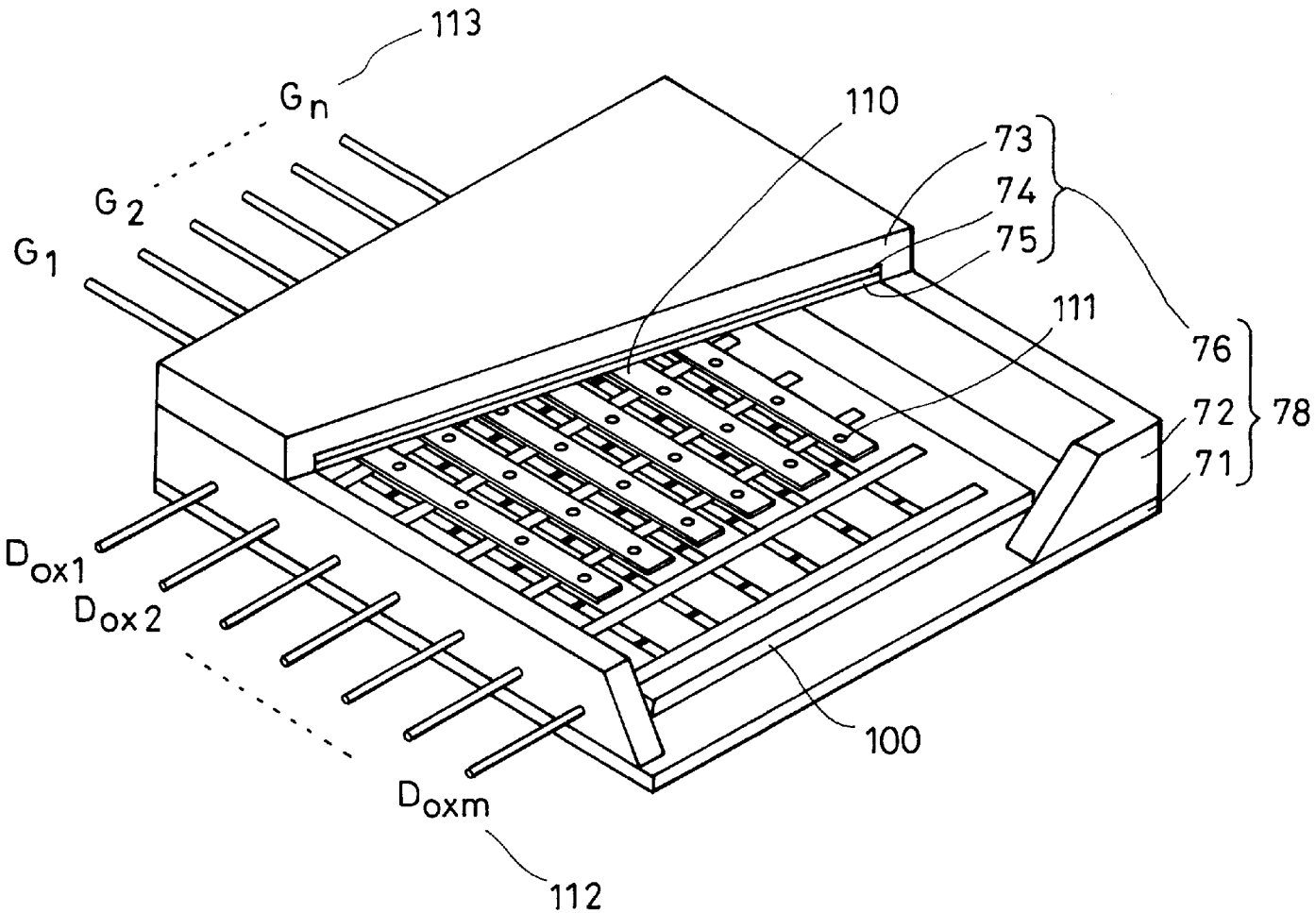
FIG. 11 is a schematic diagram illustrating an example of a display panel of an image forming apparatus with a ladder array, applicable to the present invention.

FIG. 11 is a schematic diagram illustrating an example of the configuration of a display panel of an image forming apparatus with a ladder array electron source. Reference numeral 110 denotes grid electrodes, 111 denotes holes for electrons to pass through, and 112 denotes terminals $Dox_1$, $Dox_2$, and so on through $Dox_m$, outside the envelope 78. Reference numeral 113 denotes grid terminals $G_1$, $G_2$, and so on through $G_n$, outside the envelope 78, connected to the grid 110. In FIG. 11, the same reference numerals as those shown in FIGS. 7 and 10 are given to the same parts. The major difference between the image forming apparatus shown here and the simple matrix array image forming apparatus shown in FIG. 7 is whether or not there are the grid electrodes 110 between the electron source substrate 100 and the face plate 76.

In FIG. 11, grid electrodes 110 are provided between the electron source substrate 100 and the face plate 76. The grid electrodes 110 are for modulating the electron beam emitted from the cathodes. One round opening 111 is provided corresponding with each cathode, in order to allow the electron beams to pass through stripe-shaped electrodes provided in an orthogonal manner with the ladder-array device rows. The form and position of the grid is not restricted to that shown in FIG. 11. For example, a mesh-like arrangement of many holes may be provided for the openings, or the grid may be placed around or near the devices.

The terminals 112 outside the envelope, and the grid terminals 113 outside the envelope are electrically connected to an unshown control circuit.

With the image forming apparatus according to the present invention, one line of modulated signals is applied to a grid electrode column in a simultaneous and synchronous manner with sequential driving (scanning) of one column of device rows. Accordingly, irradiation of each electron beam to the fluorescent member can be controlled, thereby displaying the image one line at a time.

The image forming apparatus according to the present example can be used as display apparatuses for television broadcasting, television conference systems, display devices for computers and the like, and so forth, and can further be used as image forming apparatuses for photo-printers configured using photosensitive drums and the like, and so forth.

The following is a detailed description of the present invention with reference to examples, but it should be understood that the present invention is not restricted to these examples, and encompasses all component substitutions and design changes made thereto, within the scope of achieving the objects of the present invention.

FIRST EXAMPLE

A cathode such as shown in FIGS. 1A and 1B was manufactured as the cathode according to the present example. FIG. 1A is a schematic plan view illustrating the configuration of a cathode according to the present invention, and FIG. 1B is a schematic representation of a cross-section thereof. In FIGS. 1A–1B, reference numeral 1 denotes an insulating substrate, 2 and 3 denote electrodes for applying voltage to the device, 4 denotes an organic film having electroconductivity, 5 denotes an electron emission portion, and 7 denotes a gap. Incidentally, in the Figure, L represents the spacing between electrode 2 and electrode 3, and W represents the width of the electrodes.

The method for manufacturing the cathode according to the present example will be described, with reference to FIGS. 2A–2D.

1) A quartz substrate was used as the insulating substrate 1, which was sufficiently cleansed using detergent, pure water, and organic solvent, following which electrodes 2 and 3 were formed of platinum on the surface of this substrate 1 (FIG. 2A). At this time, the spacing L between the electrodes 2 and 3 was 10 $\mu$m, the width W of the electrodes 2 and 3 was 500 $\mu$m, and the thickness d thereof was 100 nm.

2) Next, using 10 g of N,N-dimethyl acetoamide as a solvent, 0.3 g of fine carbon particles (SAF-HS, manufactured by Tokai Carbon) were used as the electroconductive material (1), and 0.5 g of poly(pyromellitamic acid dimethylester) was used as a precursor for the organic material (2). These mixed to prepare a mixed fluid. The mixed fluid 6 was then applied on the substrate 1 upon which the electrodes 2 and 3 had been formed, using a spinner (FIG. 2B).

3) The substrate 1 with the mixed fluid 6 applied thereupon was subjected to thermal treating for 15 minutes in an oven at 350° C., thereby evaporating the solvent, consequently forming an electroconductive organic film 4 comprising carbon within a polyimide film (FIG. 2C). The resistance value of the formed electroconductive organic film 4 was $10^4$ Ω/□ in sheet resistance, and the thickness of the film was 100 nm.

4) Next, the forming process was performed. The substrate was placed within the vacuum processing apparatus shown in FIG. 4, and a current was caused to flow through the electroconductive organic film 4, using a power source 51. Consequently, a gap 7 was formed at a portion of the electroconductive organic film 4 (FIG. 2D). The area 8 near this gap 7 comprises the electron emission portion 5.

Examining the area 8 near the electron emission portion 5 using Raman spectroscopy revealed that graphite had been formed at the portions facing the gap 7 and the portions near the gap 7. It is believed that this graphite was formed by the polyimide making up the above electroconductive organic layer being graphite-ized (carbonized). Incidentally, in reality, the border between the carbonized area 8 and the area 4 of the electroconductive organic layer is not defined as a clear line such as shown in FIGS. 1 and 2. Actually, the carbonized area 8 and the area 4 of the electroconductive organic layer are intermingled at the border. The border has been represented as a clear line here for facilitating ease of description. Also, the measurement results showed that amorphous carbon also existed, in addition to the graphite.

FIG. 3A shows an example of the voltage waveform used in the electrical forming. In FIG. 3A, T1 and T2 denote the pulse width and pulse interval of the voltage waveform, and in the present example, T1 is set at 1 msec, T2 at 10 msec, the peak value of the triangular wave (the peak voltage when forming) at 5V, and the pressure within the vacuum apparatus during the forming processing at $1.3\times10^{-4}$ Pa, and the processing was performed for 60 seconds.

The electron emission properties of the device manufactured such were measured with the measurement evaluation apparatus shown in FIG. 4. Device voltage Vf was applied between the electrodes 2 and 3 of the cathode, and measuring the device current If and emission current Ie flowing at that time yielded the current/voltage properties shown in FIG. 5.

A face plate 76 having the above-described fluorescent film 74 and metal backing 75 was placed within the vacuum apparatus, instead of the anode electrode 44. Electron emission from the electron source was performed in this state, resulting in a portion of the fluorescent film generating light, with the intensity of the light changing according to the device current Ie, hence showing that the present device functions as a light emitting display device.

Though the above-described example involves applying triangular wave pulses between the electrodes when forming the electron emission portions, thereby conducting electrical forming; however, the present invention is by no means restricted to triangular wave pulses to be applied between the electrodes 2 and 3; rather, desired waveforms such as rectangular pulses can be used. Also, the wave peak, pulse width, pulse intervals, etc., are by no means restricted to the above values. Accordingly, desired wave peak, pulse width, pulse intervals, etc., can be selected as long as the electron emitting portion is suitably formed.

SECOND EXAMPLE

The present example was formed in the same manner as the First example, except for replacing the material comprising the mixed fluid 6 used therein.

With the present example, 10 g of N,N-dimethyl acetoamide were used as a solvent, 0.4 g of indium oxide (III) (manufactured by Kishida Kagaku) were used as the electroconductive material (1), and 0.5 g of poly(pyromellitamic acid dimethylester) was used as a precursor for the organic material (2). The mixed fluid 6 formed of these was then applied on the substrate 1 upon which the electrodes 2 and 3 had been formed, using a spinner. A cathode was manufactured by forming performed in the same manner as with the First example, and it was shown that this cathode had electron emission properties similar to those of the First example.

Raman spectroscopy of the electron emitting portion 5 revealed that graphite had been formed at the area 8 of the electroconductive organic film 4 facing the gap 7 and the portions thereof near the gap 7, as with the First example.

It is believed that this graphite observed in the present example was formed by the polyimide being carbonized by the forming process.

THIRD EXAMPLE

The present example was formed in the same manner as the First example, except for replacing the material comprising the mixed fluid 6 used in the First example.

Here, 10 g of N,N-dimethyl acetoamide were used as a solvent, 1.6 g of an organic palladium complex was used as a precursor to the electroconductive material (1), and 0.5 g of poly(pyromellitamic acid dimethylester) was used as a precursor for the organic material (2). The mixed fluid 6 formed of these was then applied on the substrate 1 upon which the electrodes 2 and 3 had been formed, using a spinner, and the forming was performed in the same manner as with the First example, thereby yielding a cathode. It was shown that this cathode had electron emission properties similar to those of the First example.

Raman spectroscopy of the electron emitting portion 5 revealed that graphite had been formed at region 8 of the electroconductive organic film 4 facing the gap 7 and the portions thereof near the gap 7.

FOURTH EXAMPLE

The present example replaced the material comprising the mixed fluid in the First example with another. Also, application of the mixed fluid was performed using the ink-jet method (bubble-jet method).

With the present example, a mixed fluid of 1% polyamic acid dimethylester as a precursor for the organic material (2), 1.6% palladium acetate as a precursor for the electroconductive material (1), and N-methyl pyrolidone (NMP) as a solvent, were used.

This mixed fluid was placed in a bubble-jet printer head BC-01 shown in FIG. 18, manufactured by Canon, external voltage was applied to the certain heaters 22 within the head, thus ejecting the mixed fluid 6 of amic acid methyl ester and palladium acetate onto the gap portion between the electrodes 2 and 3 on the quartz substrate. Ejection was repeated 3 times, with the position of the head and substrate maintained. The droplets were approximately circular, with a diameter of approximately 90 $\mu$m (FIG. 2B).

Next, the substrate was heated in an oven in an ambient atmosphere at 350° C. for 30 minutes, thereby forming an electroconductive organic film 4 having palladium oxide and polyimide (FIG. 2C).

Next, the substrate with the electroconductive organic film 4 formed thereupon was placed in the vacuum processing apparatus shown in FIG. 4, and voltage was applied between the electrodes 2 and 3 with a power source 51 in a vacuum of $1.4\times10^{-6}$ Pa or lower. This forming process caused electrical current to flow through the electroconductive organic film 4, thereby forming the gap 7 (electron emitting portion 5) (FIG. 2D). Observing the area 8 near the electron emitting portion 5 with Raman spectroscopy revealed carbonization (amorphous carbon and/or graphite). Also, the above carbonized portion 8 was almost symmetrically formed across the gap 7. That is to say, with the gap 7 shown in FIG. 2D as the border, a generally-symmetrical carbonized (amorphous carbon and/or graphite) area 8 was formed at the portion of the electroconductive organic film 4 facing the gap 7 to the right and the portion of the electroconductive organic film 4 facing the gap 7 to the left.

FIG. 3D shows an example of the voltage waveform used in the electrical forming. In FIG. 3D, T1 and T2 denote the pulse width and pulse interval of the voltage waveform, and in the present example, T1 is set at 1 msec, T2 at 10 msec, and the absolute value of the peak value of the pulse voltage was gradually raised from zero to 25 V.

The device thus manufactured was placed in the measurement evaluation apparatus shown in FIG. 4, the apparatus was exhausted to a vacuum of $1.3\times10^{-6}$ Pa or lower, and the electron emission properties thereof were then measured.

Device voltage was applied between the electrodes 2 and 3 of the cathode, and measuring the device current If and emission current Ie flowing at that time yielded the current/voltage properties such as shown in FIG. 5. Also, the present example was capable of maintaining excellent electron emitting properties even when driven for prolonged periods of time, in comparison with the devices according to the first through third examples.

FIFTH EXAMPLE

With the present example, the mixed fluid in the Fourth example was replaced. Also, a piezoelectric ink-jet method was used. Otherwise, the present example is the same as the Fourth example.

For the mixed fluid used with the present example, 0.06 g of Carbon Black fine particles were dispersed in 10 g of an N-methyl pyrolidone solution of 1% polyamic acid dimethylester. The Carbon Black fine particles were filtered beforehand so that only those with particle diameter of 1 $\mu$m or less were selected.

This mixed fluid was placed in a piezo-jet head, external voltage was applied, thus discharging the mixed fluid between the electrodes 2 and 3, as with the Fourth example. Discharge was repeated 3 times, with the position of the head and substrate maintained. The droplets were approximately circular, with a diameter of approximately 85 $\mu$m (FIG. 2B).

Next, the substrate was heated in an oven in an ambient atmosphere at 350° C. for 30 minutes, thereby forming an electroconductive organic film 4 having Carbon Black particles and polyimide (FIG. 2C).

Next, the substrate was placed in the vacuum processing apparatus shown in FIG. 4, and voltage was applied between the electrodes 2 and 3 with a power source 51 in a vacuum of $1.4\times10^{-5}$ Pa or lower. This electrical forming caused electrical current to flow through the electroconductive organic film 4, thereby forming the electron emitting portion 5 (FIG. 2D). Observing the area 8 near the electron emitting portion 5 with Raman spectroscopy revealed carbonization (amorphous carbon and/or graphite). Also, the above carbonized (amorphous carbon and/or graphite) portion 8 was almost symmetrically formed across the gap 7, as with the Fourth example. FIG. 3D shows an example of the voltage waveform used in the electrical forming. In FIG. 3D, T1 and T2 denote the pulse width and pulse interval of the voltage waveform, and in the present example, T1 is set at 1 msec, T2 at 10 msec, and the absolute value of the peak value of the pulse voltage was gradually raised from zero to 25 V.

The device thus manufactured was placed in the measurement evaluation apparatus shown in FIG. 4, the apparatus was exhausted to a vacuum of $1.3\times10^{-6}$ Pa or lower, and the electron emission properties thereof were then measured.

Device voltage was applied between the electrodes 2 and 3 of the cathode, and measuring the device current If and emission current Ie flowing at that time yielded the current/voltage properties such as shown in FIG. 5. Also, the present example was capable of maintaining excellent electron emitting properties even when driven for prolonged periods of time.

SIXTH EXAMPLE

With the present example, an electron source comprising an arrange of a great number of cathodes according to the present invention as manufactured. The electron source fabricated with the present example will be described with reference to FIGS. 14 and 15.

1) A 1 $\mu$m film of $SiO_2$ was formed on one side of soda-lime glass by sputtering.

Figure 14A:
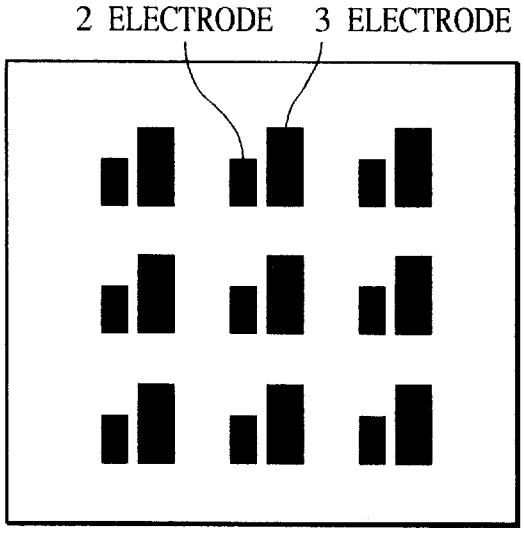
FIGS. 14A–14C are schematic diagrams illustrating the process of fabricating an electron source according to the present invention.

2) Offset printing method was used to print 1,000 by 5,000 sets of platinum electrodes 2 and 3 on the surface which upon the $SiO_2$ film was formed (FIG. 14A). Now, in FIGS. 14A through 15D, an example of 3 by 3 devices is shown to facilitate ease of understanding.

Figure 14B:
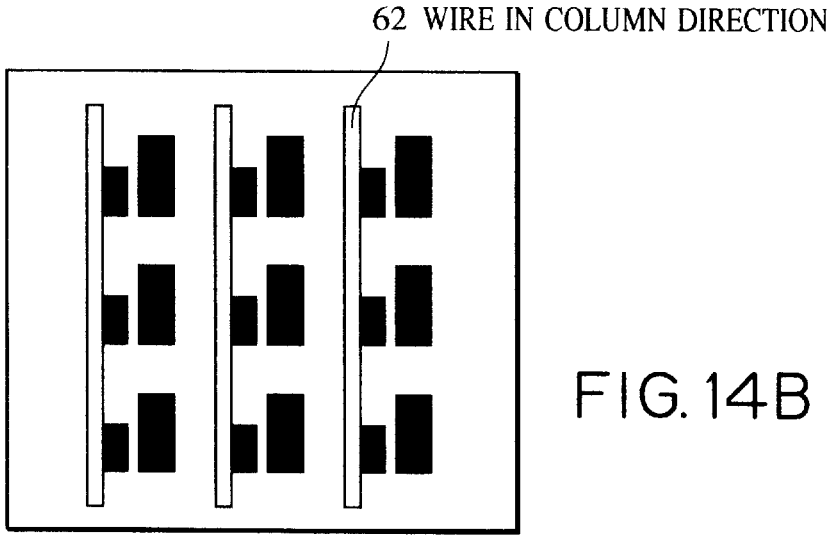

3) Next, screen printing method was used to form 5,000 column-direction wires 62 comprised mainly of Ag so as to connect the electrodes 2 in a common manner (FIG. 14B).

Figure 14C:
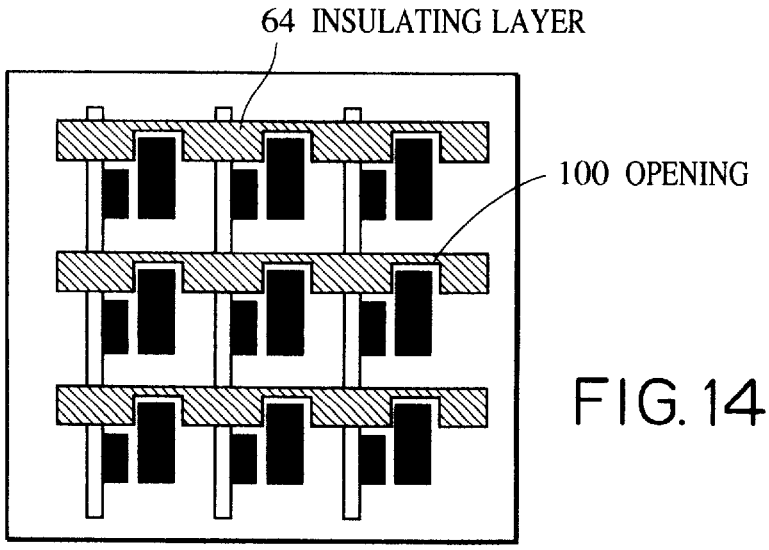

4) Next, screen printing method was used to form 1,000 lines of the insulating layer 64 comprised mainly of $SiO_2$, in a direction orthogonal to the above column-direction wires 62. The insulating layer 64 has openings 100 to allow the electrodes 3 to come into contact with the later-described row-direction wires. Accordingly, the insulating layer 64 has a comb-tooth form (FIG. 14C).

Figure 15A:
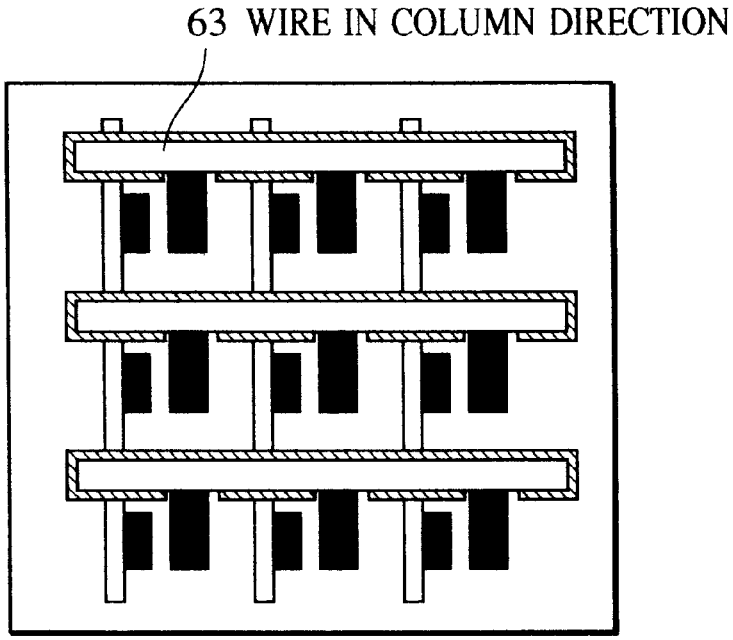
FIGS. 15A–15D are also schematic diagrams illustrating the process of fabricating an electron source according to the present invention.

5) Then, screen printing method was used to form 1,000 row-direction wires 63 comprised mainly of Ag, on the insulating layer 64. These row-direction wires 63 are in contact with the electrodes 3 at the openings in the insulating layer 64. The width of the column-direction lines is narrower than the width of the insulating layer 64 (FIG. 15A).

Figure 15B:
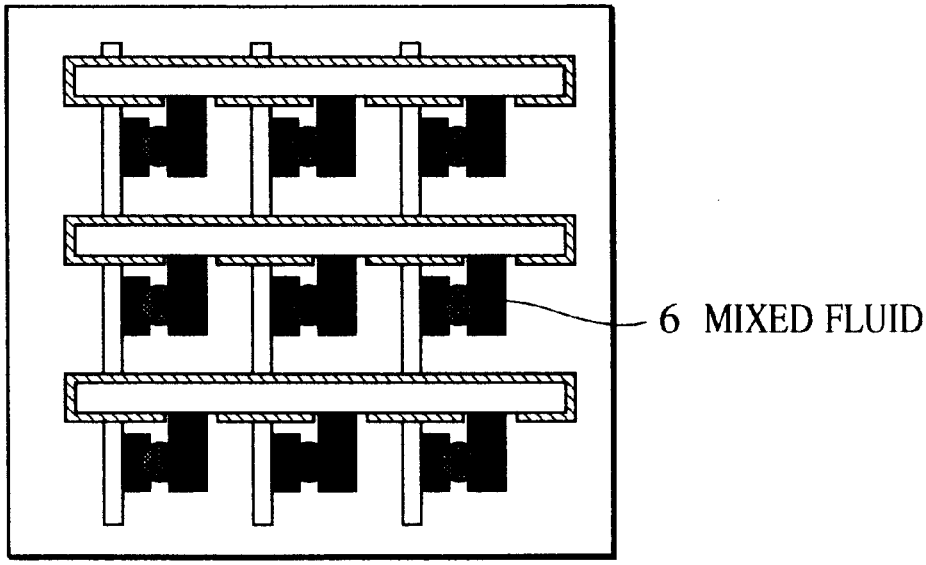

6) Next, a mixed fluid was prepared, wherein a palladium amine complex and poly(pyromellitamic acid dimethylester) were mixed into N,N-dimethyl acetoamide. Now, as described above, the organic palladium amine complex is a precursor for forming the Pd (electroconductive material (1)) in the subsequent heating process. Also, the poly (pyromellitamic acid dimethylester) is a precursor for forming the polyimide (organic material (2)) in the subsequent heating process. This mixed fluid 6 was applied using the ink-jet method so as to connect between each of the electrodes 2 and 3 (FIG. 15B). The bubble-jet droplet ejecting apparatus shown in FIG. 18B was used in the present example for the ink-jet method.

7) Next, the mixed fluid applied between the electrodes 2 and 3 was heated and baked in the atmosphere. This heading evaporated the solvent N,N-dimethyl acetoamide. At the same time, this caused the poly(pyromellitamic acid dimethylester) to change into polyimide. Further, the palladium amine complex changed to PdO.

Figure 15C:
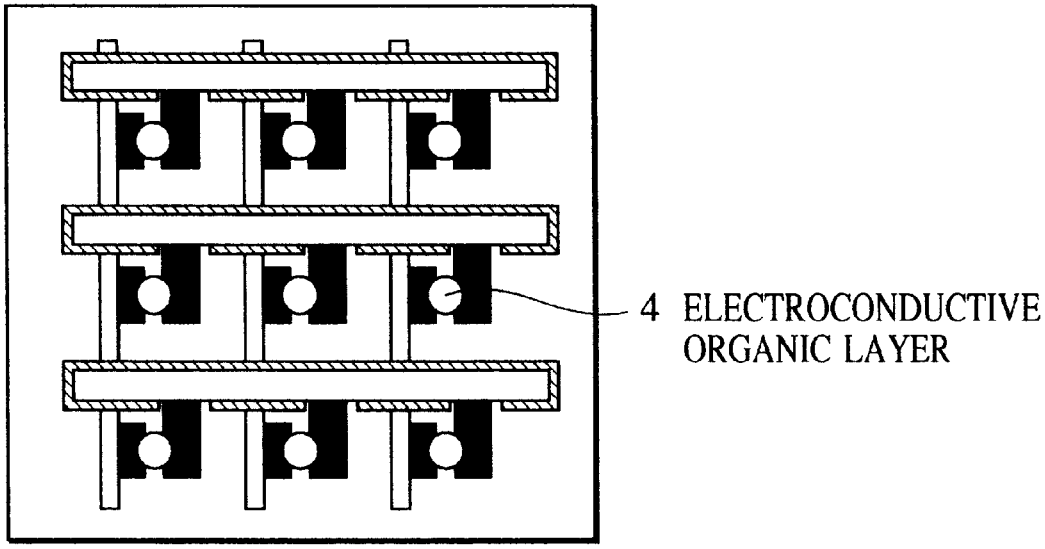
Figure 15D:
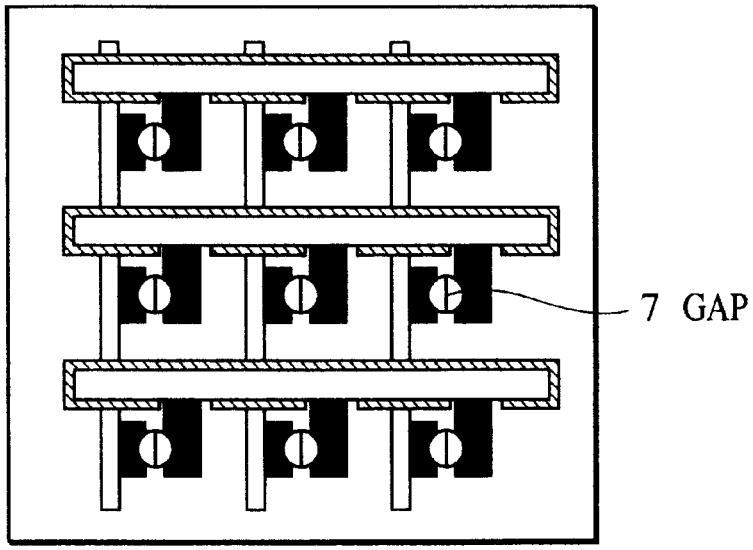

This process formed an electroconductive organic layer 4 between each of the electrodes 2 and 3 with a sheet resistance of $5\times10^4$ $\Omega/\square$ and 100 nm in thickness (FIG. 15C).

8) Next, the substrate with the electroconductive organic layer 4 formed thereupon was placed in a vacuum chamber. Then, voltage was applied to certain row-direction wires 63 and column-direction wires 62, so that electrical current flows through the electroconductive organic layer 4 between the electrodes 2 and 3. The voltage waveform applied to the wires here is shown in FIG. 3D. This process created the gap 7 in the electroconductive organic layer 4.

Observing the electroconductive organic layer 4 facing the gap 7 and the electroconductive organic layer 4 near the gap 7 with a TEM (transmission electron microscope) and UV Raman spectroscopy revealed areas 8 of carbonization (amorphous carbon and/or graphite). Also, the above carbonized portion 8 was almost symmetrically formed across the gap 7. That is to say, with the gap 7 in FIG. 2D as the border, a generally-symmetrical carbonized (amorphous carbon and/or graphite) area 8 was formed at the portion of the electroconductive organic film 4 facing the gap 7 to the right and the portion of the electroconductive organic film 4 facing the gap 7 to the left.

The electron source thus manufactured was placed in a vacuum atmosphere of $10^{-7}$ Pa, and an anode electrode was placed above. Driving each cathode yielded electron emitting properties with uniform properties.

With the present example, all components on the electron source substrate can be formed by printing (offset printing, screen printing, ink-jet). Accordingly, there is no need for a vacuum process, thereby reducing the need for massive equipment. Also, patterning is performed at the same time as forming the film on the substrate with each process, so the process was simplified greatly.

Figure 12A:
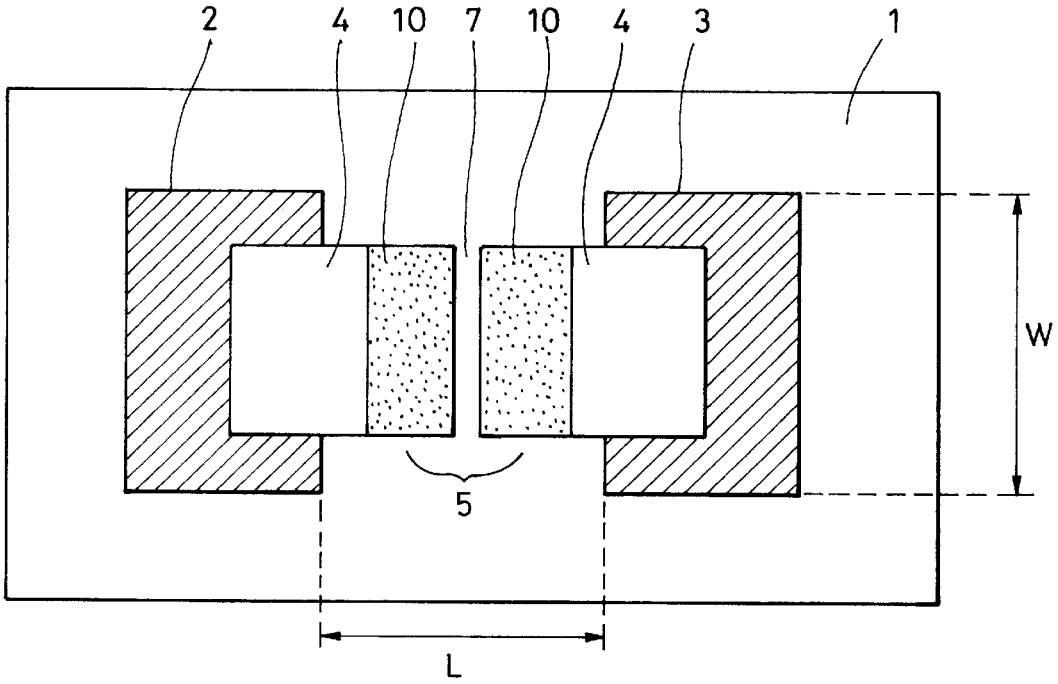
FIGS. 12A–12B are schematic diagrams illustrating an example of a conventional surface conduction cathode.
Figure 12B:
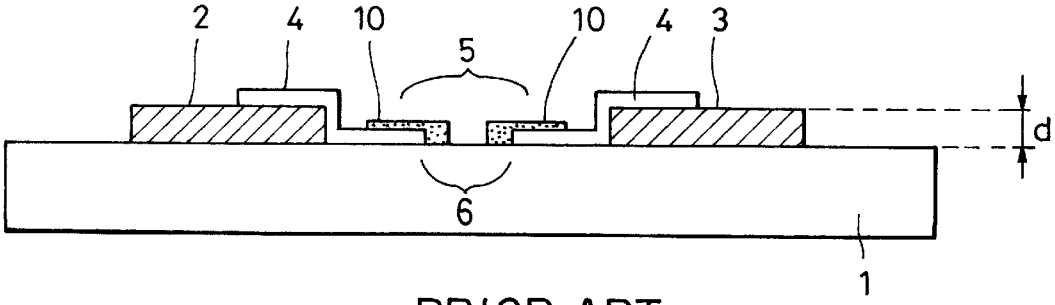
PRIOR ART FIG. 12B

Also, while conventional arrangement required two process for forming the gap 6 and forming the gap 7 (i.e., forming of the carbon film 10), as shown in FIGS. 12 and 13, the element can be formed by formation of the gap 7 in the electroconductive organic film 4, thereby greatly simplifying the process.

Also, there is no need for introduction of organic material gas serving as the ingredients for the carbon film 10 into the vacuum atmosphere, nor is there any need for the evacuation thereof, so the amount of time necessary for introduction and evacuation is reduced.

Also, conventionally, a baking process was necessary to remove all residual organic gas from the ingredients for the carbon film 10 before driving the device. However, with the present example, there is no need to performing a process for removing (baking) residual organic material adhering to the substrate and devices, which goes with introduction of such organic material gas.

SEVENTH EXAMPLE

The present example illustrates an example of a flat panel display using the electron source fabricated in the Sixth example. The display shown schematically in FIG. 7 was manufactured as the present example. However, while the electron source substrate 61 and rear plate 71 are separate parts in FIG. 7, the electron source substrate also serves as the rear plate with the present example.

The processes 1) through 8) were carried out in the same manner as with the Fourth example. With the present example, the substrate on which the cathodes are formed is the rear plate.

9) In the same atmosphere wherein the gap 7 was created in the previous process 8), the properties of each of the devices on the electron source (rear plate) were then inspected.

10) An electron source substrate 61 (rear plate) regarding which each of the devices described in 9) thereon have been judged to be free of abnormalities in electric properties and of defects (i.e., devices of passing quality), and a face plate 76 and supporting frame 72 which had been fabricated beforehand and passed inspection, were made to face one another, and positioning thereof was performed. Incidentally, bounding material is positioned beforehand at the portion where the supporting frame 72 comes into contact with the face plate 76 and the portion where the supporting frame 72 comes into contact with the rear plate (electron source) 61. Frit glass was used in the present example.

11) Heating the above bonding portions bonded and fixed (sealed) the face plate 76, supporting frame 72, and the rear plate 61, thereby forming the envelope 78.

12) Next, the interior of the envelope 78 was exhausted to a vacuum of $10^{-6}$ Pa via an unshown exhaust tube, and the exhaust tube was sealed off (tipped off).

The above-described driving circuit (FIG. 9) was connected to the envelope thus formed, thereby forming a flat panel display. Driving this display yielded an image with high uniformity and brightness.

EIGHTH EXAMPLE

An image forming apparatus was formed basically in the same manner as the Seventh example.

For the mixed fluid 6 used with the present example, the mixed fluid used with the Seventh example was substituted with 0.06 g of graphite fine particles serving as an electroconductive material dispersed in 10 g of an N-methyl pyrolidone solution of 1% polyamic acid dimethylester. Also, the Carbon Black fine particles were filtered beforehand so that only those with particle diameter of 1 $\mu$m or less were selected.

Further, as with the Fifth example, this mixed fluid 6 was discharged with a piezo-jet head between the electrodes 2 and 3. The form of the formed electroconductive organic film 4 was similar to that in the Fifth example.

With the image forming apparatus fabricated according to the present example as well, an image forming apparatus with excellent brightness and uniformity, and a long life span, was obtained.

NINTH EXAMPLE

With the present example, an electron source substrate wherein cathodes are wired in a matrix form, as shown schematically in FIG. 6, was used. As with the First example, a mixed fluid 6 comprising N,N-dimethyl acetoamide as a solvent, fine carbon particles (SAF-HS, manufactured by Tokai Carbon) as the electroconductive material (1), and poly(pyromellitamic acid dimethylester) as a precursor for the organic material (2), was applied to the electrodes 2 and 3 comprising the devices on the substrate, by printing. subsequently, the electroconductive organic film 4 was formed by heat processing. Then, using the same pulse waveforms as with the Fourth example, the electroconductive organic film was subjected to electrical forming, thereby forming electron emission portions 5, thus completing the electron source substrate.

A rear plate 71, supporting frame 72, and face plate 76 were bonded and vacuum-sealed to the electron source substrate, thereby manufacturing an image forming apparatus following the conceptual diagram shown in FIG. 7. A certain voltage was applied to each device in time-division, via the terminals $Dx_1$ through $Dx_{16}$ and $Dy_1$ through $Dy_{16}$, and a high voltage is applied to the metal backing via the terminal Hv. Hence, it was confirmed that an image forming apparatus which allows an arbitrary matrix image pattern to be displayed and which yields high uniformity could be thus formed.

TENTH EXAMPLE

An image forming apparatus was formed according to the present example, in the same manner as with the Ninth example. The only point that differs with the Ninth example is that the mixed fluid 6 for forming the electroconductive organic layer 4 was the same as that used with the Second example.

As with the Second example, a mixed fluid 6 comprising N,N-dimethyl acetoamide used as a solvent, indium oxide (III) (manufactured by Kishida Kagaku) as the electroconductive material (1), and poly(pyromellitamic acid dimethylester) as a precursor for the organic material (2), was applied to the electrodes 2 and 3 on the substrate, by printing. Subsequently, the electroconductive organic film 4 was formed by heat processing. Then, using the same pulse waveforms as with the Fourth example, the electroconductive organic film 4 was subjected to electrical forming, thereby forming electron emission portions 5, thus completing the electron source substrate.

An image forming apparatus was manufactured using this electron source substrate in the same manner as the Ninth example, and, as with the Ninth example, an image forming apparatus with excellent uniformity was obtained.

ELEVENTH EXAMPLE

An image forming apparatus was formed according to the present example, in the same manner as with the Ninth example. The only point that differs with the Ninth example is that the mixed fluid 6 for forming the electroconductive organic layer 4 was the same as that used with the Third example. As with the Third example, a mixed fluid 6 comprising N,N-dimethyl acetoamide as a solvent, an organic palladium complex as a precursor to the electroconductive material (1), and poly(pyromellitamic acid dimethylester) as a precursor for the organic material (2), was applied to the electrodes 2 and 3 on the substrate, by printing. Subsequently, the electroconductive organic film 4 was formed by heat processing. Then, using the same pulse waveforms as with the Fourth example, the electroconductive organic film 4 was subjected to electrical forming, thereby forming electron emission portions (gaps), thus completing the electron source substrate.

An image forming apparatus was manufactured using this electron source substrate in the same manner as the Ninth example, and, as with the Ninth example, it was confirmed that an image forming apparatus with excellent uniformity could be obtained.

TWELFTH EXAMPLE AND FIRST COMPARATIVE EXAMPLE

The basic structure of the cathode according to the present example is similar to that shown in FIG. 16, so the method for manufacturing the cathode according to the present invention will be described with reference to FIGS. 16 and 17.

Incidentally, a cathode was also manufactured as a comparative example. The substrate upon which the cathode according to the present invention is to be formed shall be referred to as "substrate A", and the substrate upon which the cathode according to the comparative example is to be formed shall be referred to as "substrate B" (comparative substrate). Also, six identical devices are formed on the substrate.

First, the method of manufacturing the substrate A according to the present invention shall be described.

Process a: A quartz substrate was used as the insulating substrate 1, which was sufficiently cleansed using detergent, pure water, and organic solvent, following which electrodes 2 and 3 were formed of platinum on the surface of this substrate 1 by sputtering using a mask (FIG. 17A). At this time, the spacing L between the electrodes was 2 $\mu$m, the width W of the electrodes was 500 $\mu$m, and the thickness thereof was 100 nm (FIG. 17A).

Process b: Next, 38 g of N-methyl-2-pyrolidone as a solvent, 2 g of polyamic acid as a precursor for the organic material (2), and 0.9 g of Carbon Black (#5500, manufactured by Tokai Carbon) a precursor for the electroconductive organic material (1) were uniformly mixed to prepare a mixed fluid. At this time, a ball mill (zirconia, 0.3 mm in diameter, manufactured by Token Sangyo) was used for the dispersion of the Carbon Black. The mixed fluid 6 was then applied on the substrate upon which the electrodes 2 and 3 had been formed, using a spinner at 1500 rpm for 60 seconds (FIG. 17B). Incidentally, FIG. 17B shows a view wherein the mixed fluid 6 has been patterned, in order to facilitate ease of understanding.

Process c: The substrate was subjected to thermal treating for 30 minutes in an oven at 350° C., thereby forming an electroconductive organic film 4 comprising Carbon Black within a polyimide film (electroconductive organic film) 4 (FIG. 17C).

Process d: Subsequently, a solution 9 comprising a 5% solution of polyamic acid which is a precursor for the organic material (2) in N-methyl-2-pyrolidone as a solvent was applied on the electroconductive organic film 4, using a spinner at 1500 rpm for 60 seconds (FIG. 17D).

Incidentally, FIGS. 17B–17D show views wherein the mixed fluid 6, electroconductive organic film 4, and solution 9 as is a precursor for the organic material (2), have been patterned, in order to facilitate ease of understanding.

Process e: Subsequently, the substrate was subjected to thermal treating for 30 minutes in an oven at 350° C., thereby forming a covering film (organic film) 8.

Next, resist material (AZ1500, manufactured by Hoechster) was applied using a spinner at 2000 rpm for 30 seconds, for the purpose of patterning the electroconductive organic film 4 and the covering film (organic film) 8, and following heating at 90° C. for 30 minutes, the substrate was exposed using a patterned mask, developed with a developing agent, and heated for 30 minuets at 120° C. Then, etching was performed by oxygen plasma etching, the resist was peeled off by 10 minutes of ultrasound irradiation in acetone (FIG. 17D).

The thickness of the electroconductive organic film 4 thus patterned and sheet resistance thereof was 180 nm and $2\times10^5$ Ω/□. On the other hand, the film thickness of the covering film (organic film) 8 was 50 nm.

Figure 19:
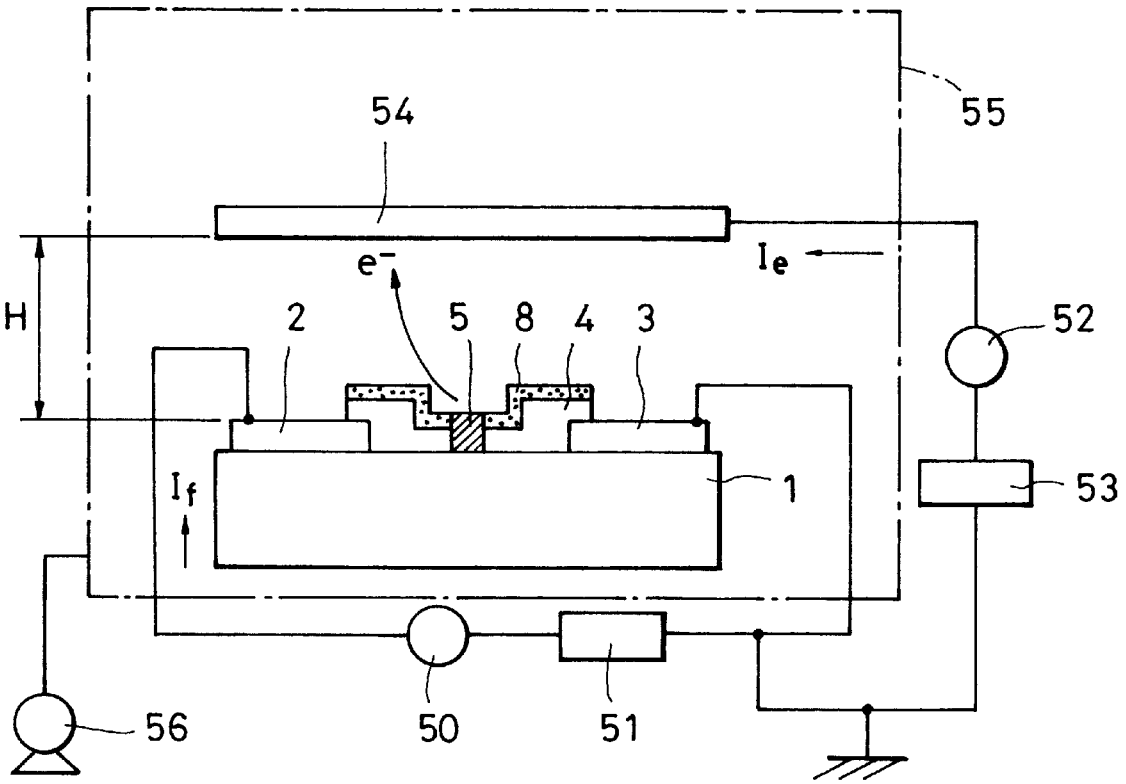
FIG. 19 is a schematic diagram illustrating an example of a vacuum processing apparatus having measurement evaluating functions.

Process f: Next, the forming process was performed. The substrate A was placed within the measurement evaluation apparatus shown in FIG. 19, evacuated with a vacuum pump 56 to a pressure of $1\times10^{-4}$ Pa, following which voltage was applied between the electrodes 2 and 3 from the power source 51 for applying the element voltage Vf to the element, thereby conducting the electrical processing (forming processing).

Rectangle pulses shown in FIG. 3D were used for the forming process. With the present example, pulse width T1 was set at 1 msec, and pulse interval T2 at 10 msec, the peak value of the rectangle wave (the peak voltage when forming) increasing by steps of 0.1 V, thereby carrying the forming out. Also, during the forming process, 0.1 V resistance measuring pulses were simultaneously inserted in the T2 intervals, thereby measuring the resistance.

The forming process was completed at the point that the measurement value of the resistance measuring pulse reaches approximately 0.1 MΩ or greater, and the application of voltage to the device was also completed at the same time. With the present example, the forming voltage was 15 V, thereby forming a gap 7 in the electroconductive organic film 4 and covering film (organic film) 8 (FIG. 17F).

Next, the method of manufacturing the comparative example substrate B will be described.

Figure 13A:
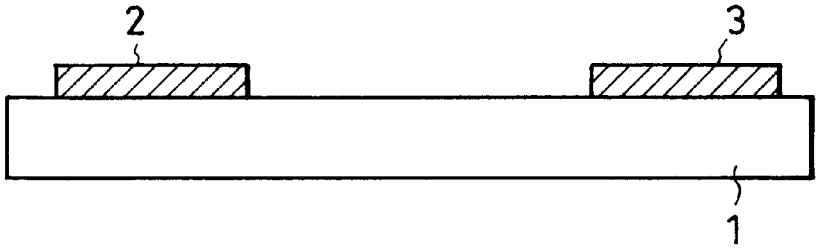
FIGS. 13A–13D are schematic diagrams illustrating an example of a conventional method for manufacturing a surface conduction cathode.

Process a: As with the Process a in the method for manufacturing the substrate A, a quartz substrate was used as the insulating substrate 1, which was sufficiently cleansed using detergent, pure water, and organic solvent, following which electrodes 2 and 3 were formed of platinum on the surface of this substrate 1 by sputtering using a mask (FIG. 17A). At this time, the spacing L between the element electrodes was 2 μm, the width W of the electrodes was 500 μm, and the thickness thereof was 100 nm (FIG. 13A).

Process b: Next, for the purpose of patterning the electroconductive film 4, chromium was applied to the entire surface to a thickness of 50 nm by vacuum vapor deposition, resist material was applied with a spinner at 2500 rpm for 30 seconds, and following heating at 90° C. for 30 minutes, the substrate was exposed using a patterned mask for applying the electroconductive film 4, developed with a developing agent, and heated for 30 minuets at 120° C.

Process c: Subsequently, the substrate was immersed for 30 seconds in a solution having the components of 17 g of $(NH_4)Ce(NO_3)_6$, 5 cc of $HClO_4$, and 100 cc of $H_2O$, thus etching the chromium, following which the resist was peeled off by 10 minutes of ultrasound irradiation in acetone. Then, an organic palladium solution was applied with a spinner at 800 rpm for 30 seconds, and heating at 300° C. for 10 minutes formed an electroconductive film 4 having palladium oxide 4.

Figure 13B:
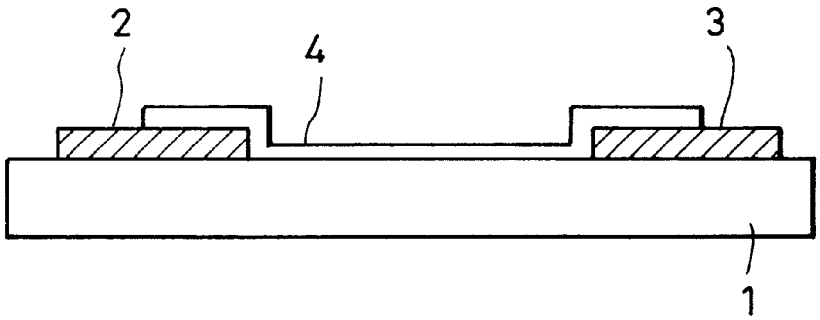

Process d: Next, the chromium was lifted off, thereby forming an electroconductive film 4 with a thickness of 10 nm and sheet resistance of $5\times10^4$ Ω/□, having palladium as the primary element thereof (FIG. 13B).

Process e: Next, the substrate B was placed within the measurement evaluation apparatus shown in FIG. 19, evacuated with a vacuum pump 56 to a pressure of $1\times10^{-4}$ Pa, following which voltage was applied between the electrodes 2 and 3 from the power source 51 for applying the voltage to the devices, thereby conducting the electrical processing (forming processing).

Rectangle pulses shown in FIG. 3D were used for the forming process. Pulse width T1 was set at 1 msec, and pulse interval T2 at 10 msec, the peak value of the rectangle wave (the peak voltage when forming) increasing by steps of 0.1 V, thereby carrying the forming out. Also, during the forming process, 0.1 V resistance measuring pulses were simultaneously inserted in the T2 intervals, thereby measuring the resistance.

Figure 13C:
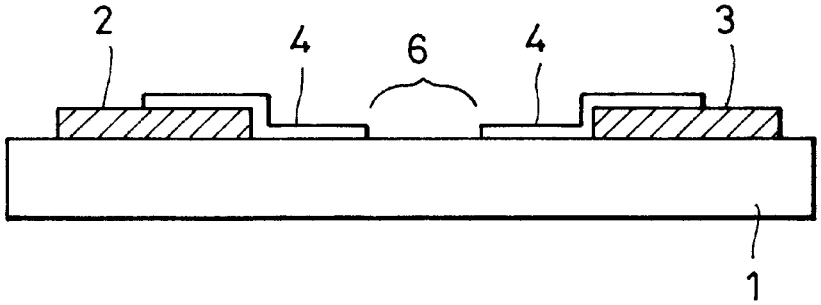
Figure 13D:
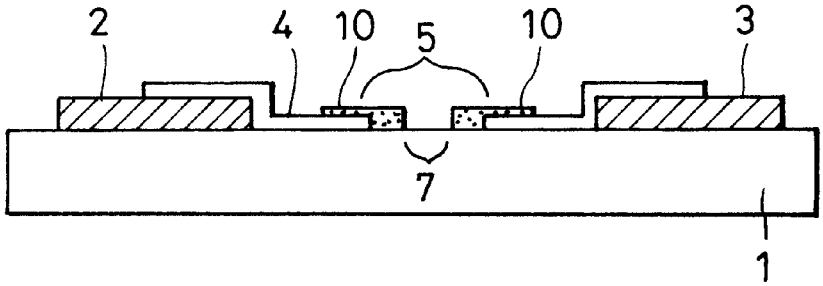

The forming process was completed at the point that the measurement value of the resistance measuring pulse reaches approximately 1 MΩ or greater, and the application of voltage to the device was also completed at the same time. With the present example, the forming voltage was 15 V, thereby forming a first gap 6 in the electroconductive film 4 (FIG. 13C).

Process f: Next, acetone was introduced into the measurement evaluation apparatus at a pressure of $1\times10^{-2}$ Pa, and voltage was applied between the electrodes 2 and 3 for 20 minutes, thereby carrying out the activation process. Incidentally, the voltage waveform for the activation processing was a rectangular waveform with the pulse width T1 being set at 1 msec and pulse interval T2 at 10 msec, and the peak value of the rectangular waveform at 15V (FIG. 3C). Then, evacuation was conducted to $1\times10^{-6}$ Pa.

The electron emitting properties of the devices thus formed were measured using the measuring evaluation apparatus shown in FIG. 4. The substrates A and B were both measured under the same measurement conditions, with the voltage of the anode electrode 54 at 1 kV, the distance H between the anode electrode and the cathode at 4 mm, and the measurement voltage as 15 V. Also, measurement was performed in the measurement evaluation apparatus at a pressure of $1\times10^{-6}$ Pa.

With the substrate B, the device current If was 1.4 mA±15%, and the emission current Ie was 0.95 μA±15%. On the other hand, with the substrate A, the device current If was 0.8 mA±3%, and the emission current Ie was 1.1 μA±4%, meaning that the emission current Ie of the substrate A as compared with the substrate B was similar, the device current If decreased, and irregularities in the electron emission properties decreased, as well.

Next, following the above properties evaluation, continuos driving was performed within the measuring apparatus under the above conditions. After a certain amount of time, the emission current Ie of the substrate B decreased to approximately 54% of the above measurement value, but the substrate A only showed a drop of 5%.

Next, the electron emitting portions of the substrate A and substrate B were observed with Raman spectroscopy, which revealed a thin deposition of amorphous carbon near the gap 7 of the electron emission portion for the substrate B, but revealed that a portion of the polyamide film 8 between the electrodes on the substrate had partially turned to amorphous carbon, and also that the amorphous carbon formed on the substrate A had portions with higher crystalline structure than the amorphous carbon formed on the substrate B.

THIRTEENTH EXAMPLE

The present example is an example of manufacturing an image forming apparatus in an electron source comprising a simple matrix array of a great number of cathodes.

Figure 20:
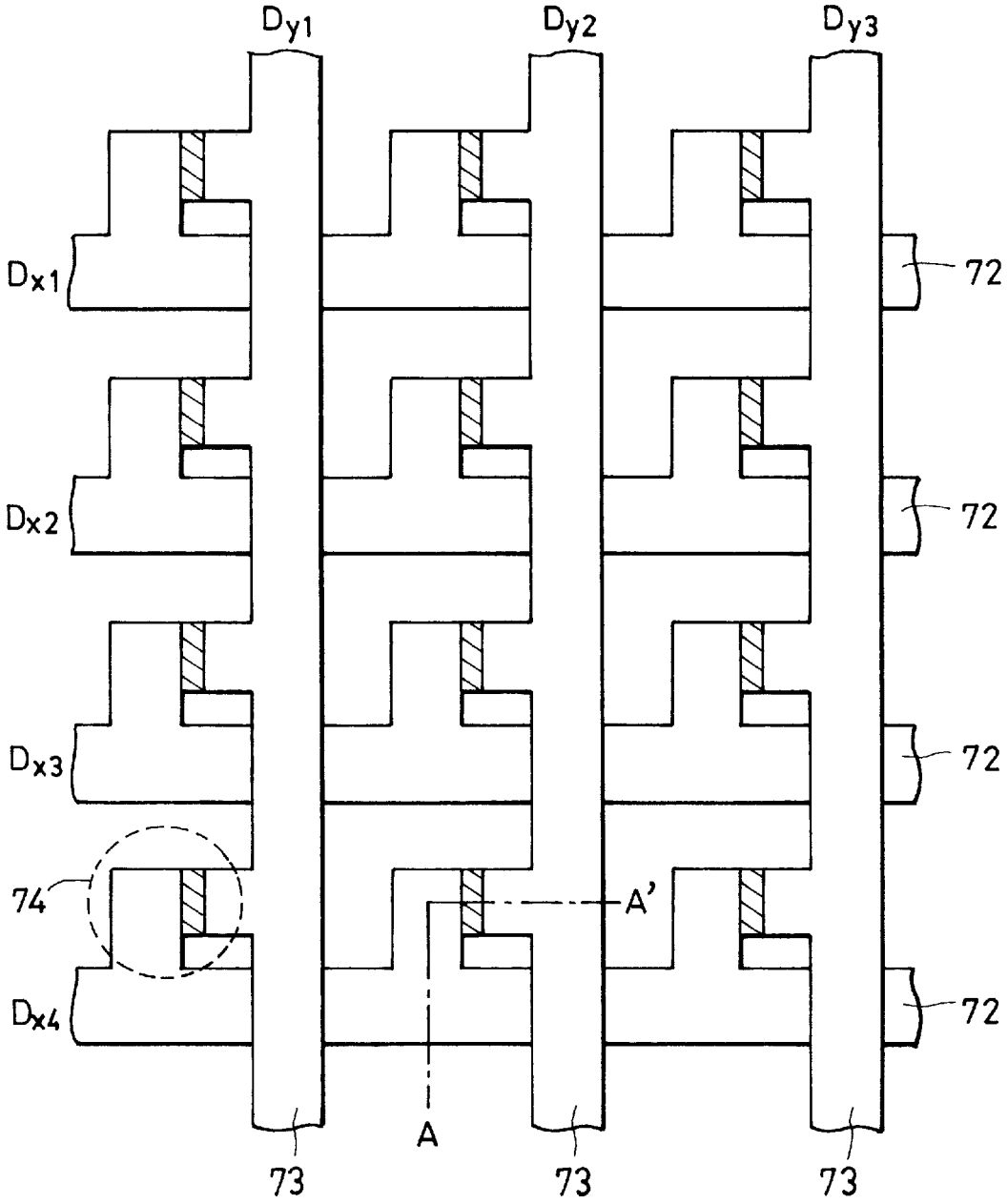
FIG. 20 is a schematic diagram illustrating a matrix-form electron source fabricated according to the present invention.
Figure 21:
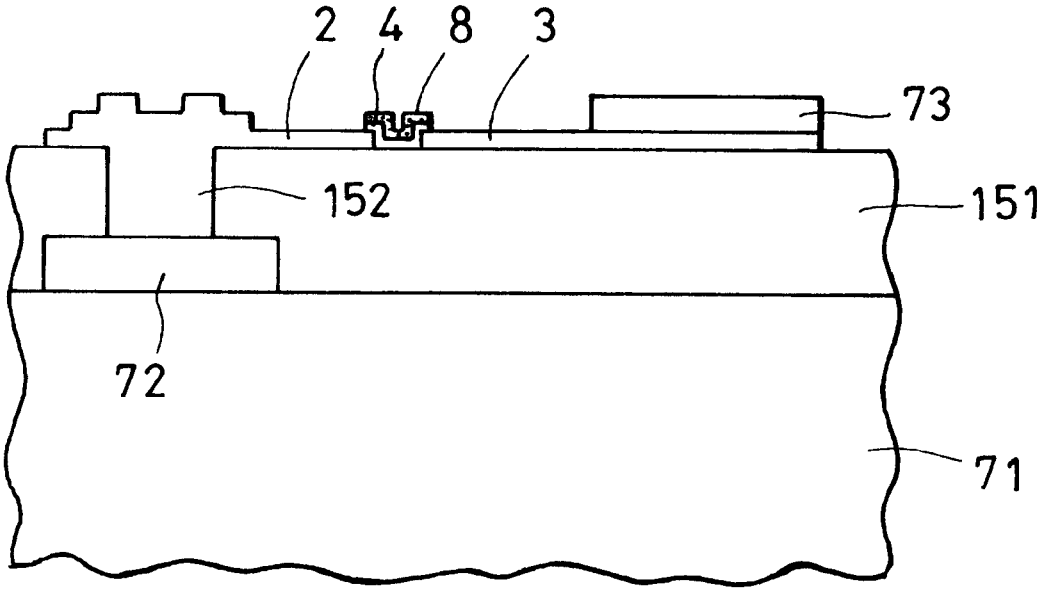
FIG. 21 is a schematic diagram illustrating the cross-section along line A–A' in FIG. 20.
Figure 22A:
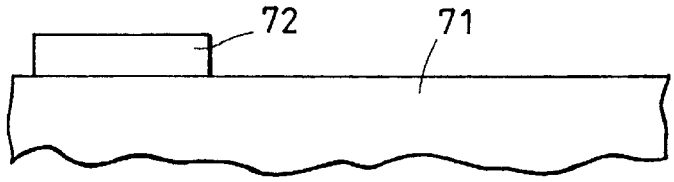
FIGS. 22A–22D is a schematic diagram illustrating a portion of the process for fabricating the electron source shown in FIG. 20.
Figure 22B:
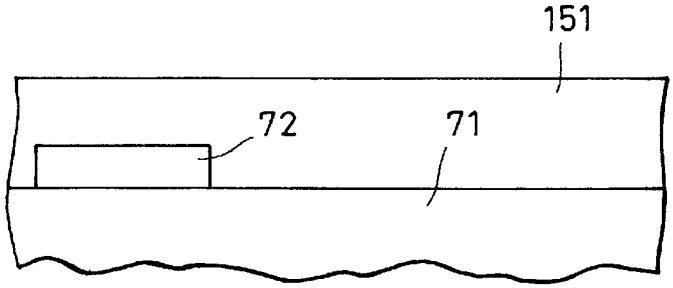
Figure 22C:
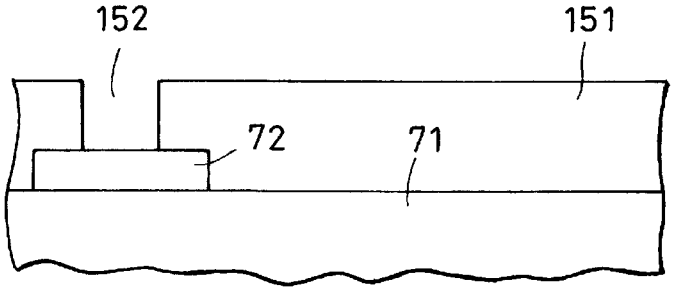
Figure 22D:
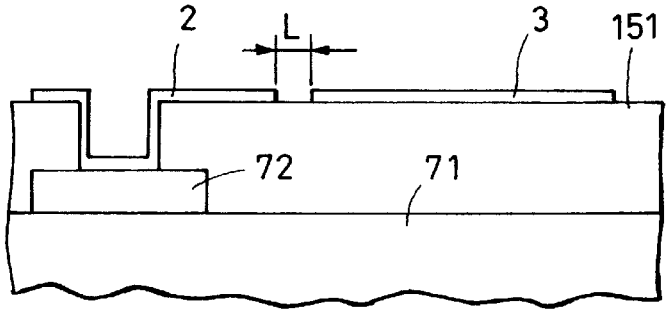
Figure 23E:
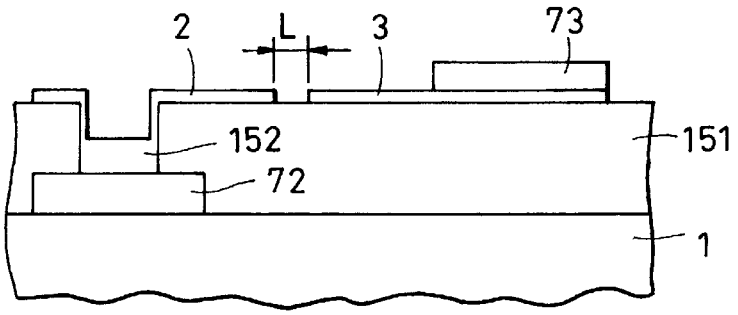
FIGS. 23E–23H are also schematic diagrams illustrating a portion of the process for fabricating the electron source shown in FIG. 20.
Figure 23F:
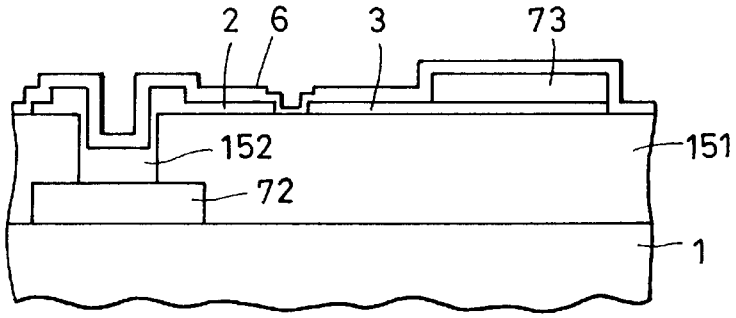
Figure 23G:
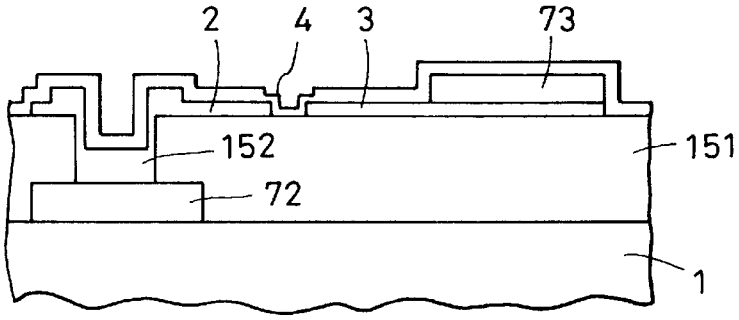
Figure 23H:
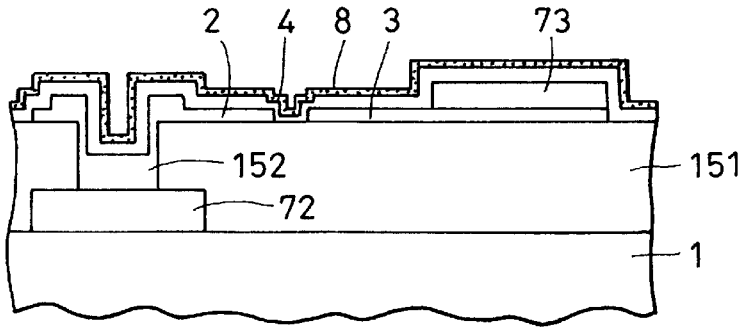
Figure 24I:
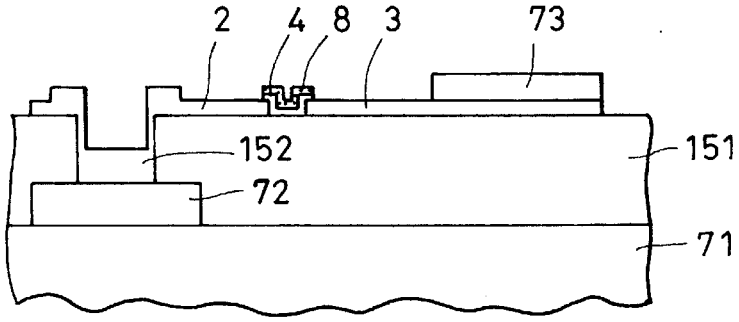
FIGS. 24I–24J are also schematic diagrams illustrating a portion of the process for fabricating the electron source shown in FIG. 20.
Figure 24J:
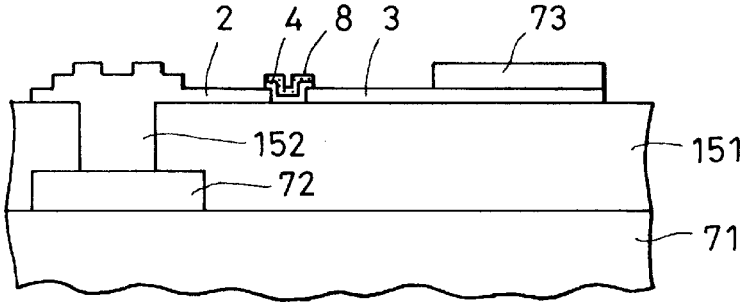

A partial plan view of a substrate upon which multiple electroconductive films have been wired in a matrix is shown in FIG. 20. Also, the cross-section along line A–A' is shown in FIG. 21. The same reference numerals in FIGS. 20 and 21 denote the same members. Here, reference numeral 71 denotes a substrate, 2 and 3 denote electrodes, 4 denotes an electroconductive organic film, and 8 denotes a covering film (organic film). Reference numeral 72 denotes X-directional wires corresponding with $Dx_m$ in FIG. 20 (also referred to as lower wires), 73 denotes Y-directional wires corresponding with $Dy_n$ in FIG. 20 (also referred to as upper wires), 151 denotes an insulating layer, and 152 denotes contact holes for electrical contact between the electrodes 2 and lower wires 72.

First, the method of manufacturing the electron source substrate according to the present invention will be described process by process with reference to FIGS. 22A through 24J. The following processes a through j correspond with the FIGS. 22A–22D, 23E–23H, and 24I–24J.

Process a: On a cleansed soda-lime glass substrate, Cr and Au were sequentially deposited by vacuum vapor deposition to respective thickness of 5 nm and 60 nm, following which resist material was applied by a spinner, baked, a photomask image is exposed and developed, thus forming the resist pattern for lower wires, and the lower wires 72 are formed from the Au/Cr deposited film by wet etching.

Process b: Next, an insulating layer 151 formed of a silicone oxide film 0.1 μm thick was formed by high-frequency sputtering.

Process c: A photo-resist pattern was formed for forming the contact holes 152 in the deposited silicone oxide film, and this was used as a mask for etching the insulating layer 151, thereby forming the contact holes 152. The etching was performed with RIE (Reactive Ion Etching) using $CF_4$ and $H_2$ gas.

Process d: Subsequently, the pattern to form the gap L between the electrodes 2 and 3 was formed of a resist material (RD-2000N-41, manufactured by Hitachi Kasei), and Ti and Ni were sequentially deposited by vacuum vapor deposition to respective thickness, of 5 nm and 100 nm. The photo-resist pattern was dissolved with an organic solvent, the Ni/Ti deposited film was lifted off, thereby forming the electrodes 2 and 3 with a spacing L of 3 μm and electrode width W of 300 μm.

Process e: A photo-resist pattern for the upper wires 73 was formed on the electrodes 2 and 3, and Ti and Au were sequentially deposited by vacuum vapor deposition to respective thickness of 5 nm and 100 nm. Unnecessary portions were lifted off and removed, thereby forming upper wires 73 of a desired form.

Process f: Next, 38 g of N-methyl-2-pyrolidone as a solvent, 2 g of polyamic acid as a precursor for the organic material (2), and 0.9 g of Carbon Black (#5500, manufactured by Tokai Carbon) as a precursor for the electroconductive material (1) were uniformly mixed to prepare a mixed fluid 6.

At this time, a ball mill (zirconia, 0.3 mm in diameter, manufactured by Token Sangyo) was used for the uniform dispersion of the Carbon Black. The dispersion liquid (mixed fluid 6) was then applied on the substrate upon which the electrodes 2 and 3 had been formed, using a spinner at 1500 rpm for 60 seconds, thereby forming a thin film of the mixed fluid 6.

Process g: Further, the thin film (mixed fluid 6) was subjected to heating and baking for 30 minutes at 350° C., thereby forming an electroconductive organic film 4 comprising Carbon Black and polyimide.

Process h: Subsequently, a solution comprising a 5% solution of polyamic acid which is a precursor for the organic material (2) in N-methyl-2-pyrolidone as a solvent was applied on the electroconductive organic film 4, using a spinner at 1500 rpm for 60. Subsequently, the substrate was subjected to baking for 30 minutes at 350° C., thereby forming a covering film (organic film) 8.

Process i: Next, resist material was applied using a spinner at 2000 rpm for 30 seconds, for the purpose of patterning the electroconductive organic film 4 and the covering film (organic film) 8, and following heating at 90° C. for 30 minutes, the substrate was exposed using a patterned mask, developed with a developing agent, and heated for 30 minuets at 120° C. Then, etching was performed by oxygen plasma etching, and the resist was peeled off by 10 minutes of ultrasound irradiation in acetone. The thickness of the electroconductive organic film 4 thus patterned and sheet resistance thereof was 180 nm and $2\times10^5$ Ω/□. On the other hand, the film thickness of the covering film (organic film) 8 was 50 nm.

Process j: A resist film was formed so as to cover all portions except for the contact hole portions, and Ti and Au were sequentially deposited by vacuum vapor deposition to respective thickness' of 5 nm and 500 nm. Removing the unnecessary portions by lifting off filled in the contact holes.

Thus, according to the above processes, a substrate 61 was obtained, with the following formed on the insulating substrate 71: the lower wires 72, insulating layer 151, upper wires 73, electrodes 2 and 3, electroconductive organic film 4, and covering film (organic film) 8.

Next, the substrate 61 was placed within a vacuum chamber, and once the interior of the chamber reached a sufficient degree of vacuum, pulse voltage was applied between the electrodes 2 and 3 of each of the cathodes 64, thus conducting the forming processing. With the present example, rectangular pulses similar to those used in the Seventh example are applied under a vacuum atmosphere of approximately $1.3\times10^{-3}$ Pa.

Next, an image forming apparatus was formed, using a substrate 61 (FIG. 7) manufactured as described above and having passed inspection. The manufacturing procedures will be described with reference to FIGS. 7–8B.

First, following fixing the substrate 61 on the rear plate 71, the face plate 76 (comprising the fluorescent film 74 and metal backing 75 formed on the inner side of the glass substrate 73) is positioned 5 mm above the substrate 61 with the supporting frame 72 introduced therebetween, frit glass is applied at the portions where the face plate 76, supporting frame 72, and rear plate 71 are assembled, and these are bonded by baking at 400 to 500° C. for 10 minutes or more in the ambient atmosphere or in a nitrogen atmosphere, thereby forming a panel (the envelope 78 in FIG. 7). Incidentally, the substrate 61 was fixed to the rear plate 71 with frit glass, as well.

In order to realize color, the fluorescent film 74 was formed as a striped formation (see FIG. 8A), with black stripes being formed first and the fluorescent member 82 for each color being applied in the gaps by the slurry method, thereby forming the fluorescent film 74. Commonly-used material comprised mainly of black lead or was used for the black stripes.

Also, a metal backing 75 was provided to the inner side of the fluorescent film 74. The metal backing 75 was manufactured by performing a smoothing process (commonly referred to as "filming") on the inner side surface of the fluorescent film 74 following fabricating the fluorescent film 74, and then depositing aluminum using vacuum vapor deposition.

With the face plate 76, transparent electrodes may be provided to the outer side of the fluorescent film 74, to further improve the electroconductivity thereof. However, sufficient electroconductivity was obtained with the present example using the metal backing 75 alone, so this was omitted.

At the time of performing the above sealing, there is the need with color devices to correlate the fluorescent members for each color with the cathodes, so sufficient positioning was performed.

The atmosphere within the panel (envelope 78) is reduced to a pressure of around $1.3\times10^{-4}$ Pa by vacuum pump via an unshown exhausting tube, following which the exhausting tube is sealed off (tipped off) by heating with a gas burner. Finally, getter processing was performed with the high-frequency heat method in order to maintain the vacuum within following sealing off, thus completing the panel.

The external terminals $Dox_1$ through $Dox_m$, external terminals $Doy_1$ through $Doy_n$, and high voltage terminal 77 of the display panel were connected to the respective required driving circuits, thereby completing the image forming apparatus. Scanning signals and modulating signals from unshown signal generating means are sequentially applied via the $Dox_1$ through $Dox_m$ and $Doy_1$ through $Doy_n$, thereby causing electron emission, and a high voltage of several kV or greater is applied from the high-voltage terminal 77 to the metal backing 75, thereby accelerating the electron beams, which collide with the fluorescent film 74, causing excitation and light emission thereof. Thus, an image was displayed.

Consequently, irregularities in properties from one cathode to another are small with the image forming apparatus according to the present example, so a high-quality image with only small irregularities in brightness can be displayed.

FOURTEENTH EXAMPLE

The present example is an example of using an electron source such as shown in FIG. 10, wherein a great number of cathodes are wired in a ladder-like form, to form an image forming apparatus such as shown in FIG. 11.

The electron source substrate 100 according to the present example is an extension of the pattern for forming cathodes described in the Ninth example, and can be formed by forming wires for common connection of multiple devices; accordingly, the details of the method for manufacturing will be omitted.

Regarding manufacturing the image forming apparatus, first, the electron source substrate 100 comprising multiple cathodes with gaps 7 were connected in a ladder-like form is fixed above the rear plate 71, following which, grid electrodes 110 having electron through holes 111 were arrayed above the substrate 100 in a direction orthogonal to the above linear elements. Further, the face plate 76 (comprising the fluorescent film 74 and metal backing 75 formed on the inner side of the glass substrate 73) is positioned 5 mm above the electron source substrate 100 with the supporting frame 72 introduced therebetween, frit glass is applied at the portions where the face plate 76, supporting frame 72, and rear plate 71 are assembled, and these are bonded by baking at 400 to 500° C. for 10 minutes or more in the ambient atmosphere or in a nitrogen atmosphere, thereby forming a panel (the encasement 78 in FIG. 11). Incidentally, the substrate 100 was fixed to the rear plate 71 with frit glass, as well.

In order to realize color, the fluorescent film 74 was formed as a striped formation (see FIG. 8A), with black stripes being formed first and the fluorescent member 82 for each color being applied in the gaps by the slurry method, thereby forming the fluorescent film 74. Commonly-used material comprised mainly of black lead or was used for the black stripes.

Also, a metal backing 75 was provided to the inner side of the fluorescent film 74. The metal backing 75 was manufactured by performing a smoothing process (commonly referred to as "filming") on the inner side surface of the fluorescent film 74 following fabricating the fluorescent film 74, and then depositing aluminum using vacuum vapor deposition.

With the face plate 76, transparent electrodes may be provided to the outer side of the fluorescent film 74, to further improve the electroconductivity thereof. However, sufficient electroconductivity was obtained with the present example using the metal backing 75 alone, so this was omitted.

At the time of performing the above sealing, there is the need with color devices to correlate the fluorescent members for each color with the cathodes, so sufficient positioning was performed.

The atmosphere within the panel (encasement 78) thus formed is reduced to a pressure of around $1.3\times10^{-4}$ Pa by vacuum pump via an unshown exhausting tube, following which the exhausting tube is sealed off by heating with a gas burner, thus sealing the envelope 78. Finally, getter processing was performed with the high-frequency heat method in order to maintain the vacuum within following sealing off, thus completing the panel.

Next, the external terminals $Dox_1$ through $Dox_m$, external terminals $G_1$ through $G_n$, and high voltage terminal 77 of the display panel were connected to the respective required driving circuits, thereby completing the image forming apparatus. Voltage is applied to the cathodes via the terminals $Dox_1$ through $Dox_m$ so as to cause electron emission, and the emitted electrons pass through the electron through holes 111 in the grid electrodes 110, and are accelerated by the high voltage of several kV or higher applied to the metal backing 77 from the high voltage terminal 77, causing the electrons to collide with the fluorescent film 74, resulting in excitation and light emission thereof.

At this time, applying voltage corresponding with the information signals to the grid electrodes 110 with the grid terminals $G_1$ through $G_n$ can control the electron beams passing through the electron through holes 111 so as to display an image, but with the present example, grid electrodes 110 having electron through holes 111 which are 50 $\mu$m in diameter were positioned 10 $\mu$m above the electron source substrate 100, with an insulating layer of $SiO_2$ (not shown) introduced therebetween, so in the event that 6 kV is applied as acceleration voltage, turning the beams on and off was successfully controlled at a grid voltage within 50 V, thus displaying an image. Also, it was confirmed that there was little irregularity between the devices, and that the uniformity of electron emission properties was high.

FIFTEENTH EXAMPLE

Figure 25:
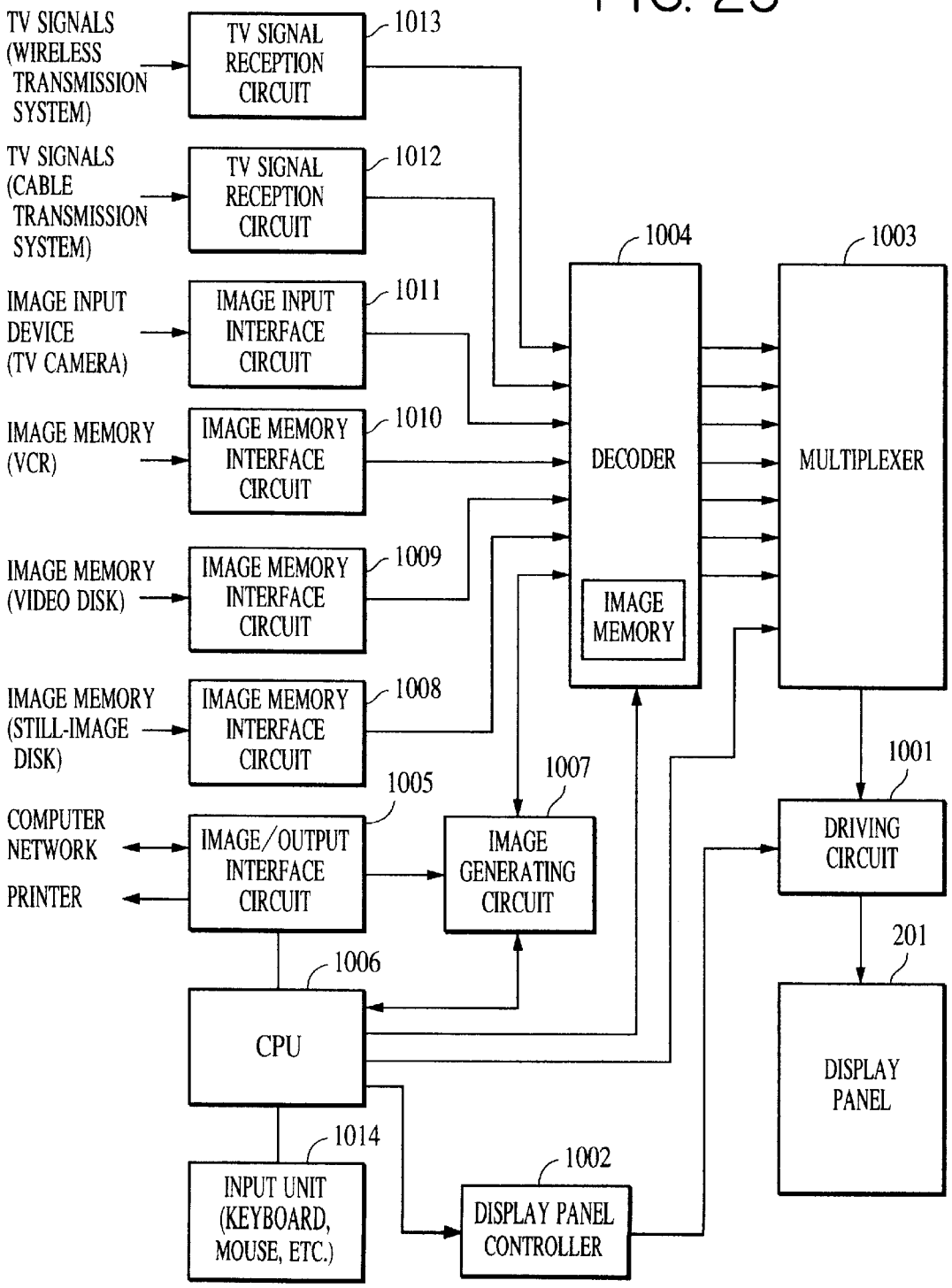
FIG. 25 is a block diagram schematically illustrating the driving circuit of the image display apparatus fabricated according to the example.

FIG. 25 is a diagram illustrating an example of an image forming apparatus according to the present invention, configured such that image information provided from various information sources such as television broadcasting for example can be displayed on the display panel formed according to the Seventh example.

In the Figure, reference numeral 201 denotes a display panel, 1001 denotes a display panel driving circuit, 1002 denotes a display controller, 1003 denotes a multiplexer, 1004 denotes a decoder, 1005 denotes an input/output interface circuit, 1006 denotes a CPU, 1007 denotes an image generating circuit, 1008 and 1009 and 1010 denote image memory interface circuits, 1011 denotes an image input interface circuit, 1012 and 1013 denote TV signal receiving circuits, and 1014 denotes an input unit.

It should be noted that in the event of receiving signals including both image information and sound information, as with television signals for example, the present image forming apparatus reproduces the sound along with displaying the image, as a matter of course, but description relating circuits, speakers, etc., which perform reception, dividing, reproducing, processing, storage, etc., of sound information will be omitted, as such is not directly related to the characteristics of the present invention.

First, the TV signal receiving circuit 1013 is a circuit for receiving television signals transmitted using a wireless transmission system, such as airwaves or space-optical communications, etc.

The type of television signals to be received is not particularly restricted, and any of NTSC, PAS, or SECAM signals may be received. Also, television signals with an even greater number of scanning lines, such as so-called high-definition TVs like MUSE or the like are suitable signal sources for optimizing the advantages of this display panel which is suitable for large areas and great numbers of pixels.

The television signals received with the TV signal receiving circuit 1013 are output to the decoder 1004.

The TV signal receiving circuit 1012 is a circuit for receiving cable television signals transmitted using coaxial cable, optical fiber, etc. As with the TV signal receiving circuit 1013, the type of television signals to be received is not particularly restricted. The television signals received with the TV signal receiving circuit 1012 are also output to the decoder 1004.

The image input interface circuit 1011 is a circuit of intake of image signals supplied from image input devices such as TV cameras or image reading scanners, and the image signals read in are output to the decoder 1004.

The image memory interface circuit 1010 is a circuit for reading image signals stored by a video cassette recorder (hereafter referred to simply as "VCR"), and the image signals read in are output to the decoder 1004.

The image memory interface circuit 1009 is a circuit for reading image signals stored on a video disk, and the image signals read in are output to the decoder 1004.

The image memory interface circuit 1008 is a circuit for reading image signals from a device storing still image data, such as a still image disk, and the image signals read in are output to the decoder 1004.

The input/output interface circuit 1005 is a circuit for connecting the present display apparatus with external computers, computer networks, or output devices such as printers or the like. Not only can input and output of image data, text and shape information be carried out, but in some cases the CPU 1006 of the present image forming apparatus and external device can exchange control signals and numerical data.

The image generating circuit 1007 is a circuit for generating image data to be displayed, based on image data, text and shape information externally input from the above input/output interface circuit 1005, or image data, text and shape information output from the CPU 1006. This circuit has within re-writable memory for storing image data, text and shape information, for example, ROM for storing image patterns corresponding with character codes, processors and the like for image processing, and other circuits necessary for generating images.

The display image data generated by this circuit is output to the decoder 1004, but in cases may be output to external computer networks or printers via the input/output interface circuit 1005.

The CPU 1006 mainly performs tasks of controlling the operation of the present display apparatus or generating, selecting, or editing display images.

For example, the CPU 1006 may output a control-signal to the multiplexer 1003, and select or combine image signals to be displayed on the display panel. In this case, the CPU 1006 generates control signals to the display panel controller 1002 according to the image signals to be displayed, and appropriately controls the operation such as regarding the image display frequency, scanning method (e.g., interlaced or non-interlaced), number of scanning lines per screen, and so forth. Also, the CPU 1006 directly outputs image data and text and shape information to the image generating circuit 1007, or accesses external computers or memory via the input/output interface circuit 1005 to input image data and text and shape information.

Incidentally, the CPU 1006 may undertake tasks with other objects, as well. For example, the CPU 1006 may directly handle functions for generating and processing information, such as with personal computers or word processors. Or, as described above, the CPU may connect to external computer networks via the input/output interface circuit 1005 and jointly perform mathematical calculations or the like in junction with other external devices.

The input unit 1014 is for the user to input commands, programs, data, etc., and a wide variety of input devices can be used to this end, such as a keyboard, mouse, joystick, barcode reader, voice recognition device, and so on.

The decoder 1004 is for performing reverse conversion of various image signals input from the above 1007 through 1013, into signals of the three primary colors, or brightness signals, and I signals and Q signals. As shown in the Figure by dotted lines, it is preferable that the decoder 1004 have internal image memory. This is to handle television signals which require image memory at the time of reverse conversion, such as MUSE signals, for example.

Having image memory facilitates ease of displaying still images. There are also the advantages that this allows the image memory to cooperate with the above image generating circuit 1007 and CPU 1006 to more readily perform image processing and editing, such as pruning interpolating, enlarging, reducing, synthesizing, etc., of images.

The multiplexer is for appropriately selecting a display image based on control signals input from the CPU 1006. That is, the multiplexer 1003 selects the desired image signals from the reverse-converted image signals input from the decoder 1004, and outputs the selected image signals to the driving circuit 1001. In such a case, the image signals may be switched and selected within a single image display period, so that different images can be displayed on different areas of one screen, as with a so-called "picture-in-picture" television.

The display panel controller 1002 is a circuit for controlling operation of the driving circuit 1001, based on the control signals input from the CPU 1006.

Regarding a basic operation of the display panel, for example, a signal for controlling the operation sequence of a driving power source (not shown) for the display panel is output to the driving circuit 1001. Regarding the method of driving the display panel, signals for controlling the image display frequency or scanning method (e.g., interlaced or non-interlaced) for example, are output to the driving circuit 1001. Also, in some cases, control signals regarding adjustment of the image quality, such as brightness, contrast, color, and sharpness of the displayed image, may be output to the driving circuit 1001.

The driving circuit 1001 is a circuit for generating driving signals to be applied to the display panel 201, and operates with regard to image signal input form the multiplexer 1003, and control signals input from the display panel controller 1002.

The above ahs been a description of the members. It should be noted that according to the configuration shown as an example in FIG. 25, the present image forming apparatus is capable of displaying image information input from a wide variety of image information sources in the display panel 201. That is to say, various image signals such as television broadcast signals are subjected to reverse conversion by the converter 1004, then appropriately selected by the multiplexer, and input to the driving circuit 1001. On the other hand, the display controller 1002 generates control signals for controlling the operation of the driving circuit 1001, according to the image signals to be displayed. The driving circuit applies driving signals to the display panel 201, based on the above image signals and control signals. Accordingly, an image is displayed on the display panel 201. This series of operations is centrally governed by the CPU 1006.

Not only is the present image forming apparatus capable of displaying information selected from the image memory stored in the decoder 1004 or image generating circuit 1007 or other information, but is capable of performing image processing to image information to be displayed, such as enlarging, reducing, rotating, moving, emphasizing edges, pruning, interpolation, color changes, changes in the vertical/horizontal ratio of the image, and so on, and image editing such as synthesizing, deleting, connecting replacing, imbedding, and so on. Also, though not mentioned in the description of the present example, a dedicated circuit may be provided whereby processing and editing of sound information can be executed, as with the above image processing and image editing.

Accordingly, the present image forming apparatus is capable of single-handedly performing the roles of television broadcast display apparatus, terminal device for teleconferencing, image editing equipment for handling still images and motion images, office terminal such as a computer terminal or word processor, game machine, and so forth; and thus has an extremely wide use, both for industrial and social uses.

Various alterations can be made to the display apparatus shown in FIG. 25, based on the technological idea of the present invention. For example, of the components shown in FIG. 25, those not necessary to the object of use may be omitted. Conversely, further functions may be added depending on the object of use. For example, in the case of using the present display apparatus as a video telephone, components such as a video camera, audio microphone, lighting equipment, a telephone line and related equipment such as a modem, etc., should be suitably provided.

According to the present display apparatus, reduction in thickness of the display panel with cathodes serving as the electron beam source is facilitated in particular, so the depth-wise dimensions of the apparatus can be reduced. Further, the present display apparatus allows for easy forming of large-area displays, has excellent brightness, and superb visual recognition properties.

Further, the uniformity of the electron emission properties of the cathodes in the electron source according to the present invention is excellent, so the formed image is high in quality, and highly detailed images can be displayed.

As described above, the present invention involves causing an electrical current to flow through electroconductive organic film, thereby forming a gap, and at the same time carbonizing (changing into graphite or amorphous carbon) the organic material near the gap. Accordingly, the introduction pressure control of the organic gas which was necessary with conventional arrangements is no longer necessary. Further, since there is no introduction of organic gas, the effects of residual gas in the vacuum atmosphere are reduced. Further, there is no process of applying organic material on top of electroconductive film, so positional offset between the organic material and electroconductive material, and complexity in the pattering procedure can be reduced. Consequently, electron emission properties with high uniformity can be easily obtained. Also, the manufacturing process of the cathodes can be reduced, leading to reductions in costs.

Also, according to the method for manufacturing electron sources according to the present invention, a set of electrodes is formed by offset printing, the electroconductive organic film is formed by ink-jet, and the lines for driving the cathodes can be formed by screen printing. Accordingly, the components of the electron source can be manufactured in a non-vacuum, and further, there is no need for separate patterning, so costs can be reduced.

Further, according to the method for manufacturing the image forming apparatus according to the present invention, the electron source can be tested before assembling (sealing) the envelope. Accordingly, an electron source which has passed inspection and a face plate which has passed inspection can be assembled. Consequently, post-sealing yield increases, so image forming apparatuses can be manufactured at low costs.

What is claimed is:

1. A method for manufacturing a cathode, comprising the steps of:

A) a process for applying onto a substrate a fluid mixture comprising polymers or precursors to said polymers, particles of an electroconductive material or an organometallic compound which is a precursor to said electroconductive material, and solvent;

B) a process for removing said solvent by heating said fluid mixture applied on said substrate, thereby obtaining an electroconductive film comprising said polymers and said electroconductive material; and C) a process for forming a gap at a portion of said electroconductive film by applying an electrical current thereto.

2. A method for manufacturing a cathode according to claim 1, wherein said process for applying said fluid mixture is performed by the ink-jet method.

3. A method for manufacturing a cathode according to claim 2, wherein said ink-jet method involves applying heat to said fluid mixture to the point of boiling so as to generate bubbles, and using the pressure of said bubbles to eject droplets of said fluid mixture.

4. A method for manufacturing a cathode according to claim 2, wherein said ink-jet method involves applying electric signals to piezoelectric elements so as to cause deformation thereof, thereby ejecting droplets of said fluid mixture.

5. A method for manufacturing a cathode according to claim 1, wherein said polymers comprise at least one selected from the following group: all-aromatic polymers, and polyacryllo nitryl.

6. A method for manufacturing a cathode according to claim 5, wherein said all-aromatic polymers comprise polyimide, polybenzoimidazole, and polyamideimide.

7. A method for manufacturing a cathode according to claim 1, wherein said electroconductive material comprises at least one selected from the following group: Pd, Ru, Ag, Cu, Tb, Cd, Fe, Pb, Zn, PdO, $SnO_2$, $In_2O_3$, PbO, $Sb_2O_3$, $HfB_2$, $ZrB_2$, $LaB_6$, $CeB_6$, $YB_4$, $GdB_2$, TiC, ZrC, HfC, TaC, SiC, WC, TiN, ZrN, HfN, polyacetylene, poly-p-phenylene, polyphenylene sulfide, polypyrrole, Si, Ge, carbon, and graphite.

8. A method for manufacturing a cathode according to claim 1, wherein said electroconductive material comprises at least one selected from the following group: metals, oxides, borides, carbides, nitrides, electroconductive high polymers, and semiconductors.

9. A method for manufacturing a cathode, comprising the steps of:

A) a step for forming on a substrate a film comprising a mixture of:

at least one organic material selected from the following group: all-aromatic polymers, and polyacryllo nitrile; and an electroconductive material; and B) a step for forming a gap at a portion of said film by applying an electrical current thereto, wherein the film has a sheet resistance of $10^3$ to $10^7$ Ω/□.

10. A method for manufacturing a cathode, comprising the steps of:

A) a step for forming on a substrate a film comprising a mixture of: at least one organic material selected from the following group: polyimide, polybenzoimidazole, polyamideimide, and polyacryllo nitrile; and an electroconductive material; and B) a step for forming a gap at a portion of said film by applying an electrical current thereto.

11. A method for manufacturing a cathode, comprising the steps of:

A) a step for forming on a substrate an electroconductive film comprising:

at least one organic material selected from the following group: all-aromatic polymers, and polyacryllo nitrile;

and an electroconductive material; and

B) a step for forming a gap at a portion of said electroconductive film by applying an electrical current thereto.

12. A method for manufacturing a cathode according to claim 11, wherein said all-aromatic polymers comprise at least one organic material selected from the following group: polyimide, polybenzoimidazole, and polyamideimide.

13. A method for manufacturing a cathode, comprising the steps of:

A) a step for forming on a substrate a film comprising an organic material and an electroconductive material; and B) a step for forming a gap and a carbonized region at a portion of said film by applying an electrical current thereto, wherein the film has a sheet resistance of $10^3$ to $10^7$ Ω/□.

14. A method for manufacturing an electron source comprising an array of a plurality of cathodes, wherein said cathodes are manufactured according to any of the claims 1 through 12.

15. A method for manufacturing an electron source comprising an array of a plurality of cathodes, wherein said cathodes are manufactured according to any of the claims 1–8, 10, and 12, said method comprising:

A) a step for forming an array of a plurality of pairs of electrodes on a substrate, using offset printing;

B) a step for forming a plurality of X-directional wires coming into common contact with one of said pair of electrodes, on said substrate using screen printing;

C) a step for forming a plurality of Y-directional wires coming into common contact with the other of said pair of electrodes, on said substrate using screen printing;

wherein said Y-directional wires are formed over said X-directional wires so as to be electrically insulated therefrom by an insulating layer formed using screen printing;

and wherein said Y-direction and said X-direction are generally perpendicular;

D) a step for positioning said electroconductive organic film so as to connect between each of said pairs of electrodes, using the ink-jet method; and E) a step for forming a gap at a portion of said electroconductive organic film by applying an electrical current thereto, via said X-directional wires and said Y-directional wires.

16. A method for manufacturing an image forming apparatus comprising an electron source comprising an array of a plurality of cathodes and image forming members positioned facing the electron source;

wherein the electron source is manufactured according to claim 15.

17. A method for manufacturing an image forming apparatus comprising an electron source comprising an array of a plurality of cathodes and image forming members positioned facing the electron source, wherein the electron source is manufactured according to claim 14.

18. A method for manufacturing a cathode according to claim 13, wherein said electroconductive material comprises at lest one selected from the following group: Pd, Ru, Ag, Cu, Tb, Cd, Fe, Pb, Zn, PdO, $SnO_2$, $In_2O_3$, PbO, $Sb_2O_3$, $HbB_2$, $ZrB_2$, $LaB_6$, $YB_4$, $GdB_2$, TiC, ZrC, HfC, TaC, SiC, WC, TiN, ZrN, HfN, Polyacetylene, poly-p-phenylene, polyphenylene sulfide, polypyrrole, Si, Ge, carbon, and graphite.

19. A method for manufacturing a cathode according to claim 18, wherein said organic material comprises at least one selected from the following group: all-aromatic polymers and polyacryllo nitryl.

20. A method for manufacturing a cathode according to claim 13, wherein said electroconductive material comprises at least one selected from the following group: metals, oxides, borides, carbides, nitrides, electroconductive polymers, and semiconductors.

21. A method for manufacturing a cathode, comprising the steps of:

A) a step for forming on a substrate a film comprising:

at least one organic material selected from the following group: polymide, polubenzoimidazole, polyamideimide, and polyacryllo nitrile; and at least one electroconductive material selected from the following group: Pd, Ru, Ag, Cu, Tb, Cd, Fe, Pb, Zn, PdO, $SnO_2$, $In_2O_3$, PbO, $Sb_2O_3$, $HbB_2$, $ZrB_2$, $LaB_6$, $YB_4$, $GdB_2$, TiC, ZrC, HfC, TaC, SiC, WC, TiN, ZrN, HfN, Polyacetylene, poly-p-phenylene, polyphenylene sulfide, polypyrrole, Si, Ge, carbon, and graphite; and B) a step for forming a gap and a carbonized region at a portion of said film by applying an electrical current thereto.

22. A method for manufacturing an electron source comprising an array of a plurality of cathodes, wherein said cathodes are manufactured according to either claim 13 or any one of claims 18 through 21.

23. A method for manufacturing said electron source according to claim 22, comprising the steps of:

A) a step of forming an array of a plurality of pairs of electrodes on a substrate;

B) a step of forming a plurality of X-directional wires coming into contact with one of said pair of electrodes;

C) a step of forming a plurality of Y-directional wires coming into contact with the other of said pair of electrodes, wherein said Y-directional wires are formed over said X-directional wires so as to be electrically insulated therefrom by an insulating layer, and said Y-directional wires and said X-directional wires are substantially perpendicular to one another; and D) a step of disposing said electroconductive film in a manner so as to be connected between each of said pairs of electrodes, on said substrate.

24. A method for manufacturing an image forming apparatus comprising an electron source and an image forming member positioned facing the electron source, wherein the electron source is manufactured according to the method of claim 22.

25. A method for manufacturing an electron source comprising an array of a plurality of cathodes, wherein said cathodes are manufactured according a method comprising the steps of:

A) a step for forming on a substrate an electroconductive film comprising a mixture of:

at least one organic material selected from the following group: all-aromatic polymers, and polyacryllo nitrile; and an electroconductive material; and B) a step for forming a gap at a portion of said electroconductive film by applying an electrical current thereto, and wherein said method for manufacturing said electron source comprises:

A) a step for forming an array of a plurality of pairs of electrodes on a substrate, using offset printing;

B) a step for forming a plurality of X-directional wires coming into common contact with one of said pair of electrodes, on said substrate using screen printing;

C) step for forming a plurality of Y-directional wires coming into common contact with the other of said pair of electrodes, on said substrate using screen printing;

wherein said Y-directional wires are formed over said X-directional wires so as to be electrically insulated therefrom by an insulating layer formed using screen printing;

an wherein said Y-direction and said X-direction are generally perpendicular;

D) a step for positioning said electroconductive organic film so as to connect between each of said pairs of electrodes, using the ink-jet method; and E) a step for forming a gap at a portion of said electroconductive organic film by applying an electrical current thereto, via said X-directional wires and said Y-directional wires.

26. A method for manufacturing an electron source comprising an array of a plurality of cathodes, wherein said cathodes are manufactured according a method comprising the steps of:

A) a step for forming on a substrate an electroconductive film comprising:

at least one organic material selected from the following group: all-aromatic polymers, and polyacryllo nitrile;

and an electroconductive material; and

B) a step for forming a gap at a portion of said electroconductive film by applying an electrical current thereto, and wherein said method for manufacturing said electron source comprises:

A) a step for forming an array of a plurality of pairs of electrodes on a substrate, using offset printing;

B) a step for forming a plurality of X-directional wires coming into common contact with one of said pair of electrodes, on said substrate using screen printing;

C) a step for forming a plurality of Y-directional wires coming into common contact with the other of said pair of electrodes, on said substrate using screen printing;

wherein said Y-directional wires are formed over said X-directional wires so as to be electrically insulated therefrom by an insulating layer formed using screen printing;

and wherein said Y-direction and said X-direction are generally perpendicular;

D) a step for positioning said electroconductive organic film so as to connect between each of said pairs of electrodes, using the ink-jet method; and E) a step for forming a gap at a portion of said electroconductive organic film by applying an electrical current thereto, via said X-directional wires and said Y-directional wires.

27. A method for manufacturing an image forming apparatus comprising an electron source comprising an array of a plurality of cathodes and image forming members positioned facing the electron source, wherein the electron source is manufactured according to claim 25.

28. A method for manufacturing an image forming apparatus comprising an electron source comprising an array of a plurality of cathodes and image forming members positioned facing the electron source, wherein the electron source is manufactured according to claim 26.

* * * * *

UNITED STATES PATENT AND TRADEMARK OFFICE

CERTIFICATE OF CORRECTION

PATENT NO. : 6,383,047 B1
DATED : May 7, 2002
INVENTOR(S) : Masato Minami et al.

It is certified that error appears in the above-identified patent and that said Letters Patent is hereby corrected as shown below:

Column 2,
Line 4, “has” should read -- have --.

Column 3,
Lines 16, 34 and 46, “polyacryllo” should read -- polyacrylo- --; and
Line 17, “nitryl.” should read -- nitride. --;

Column 7,
Line 41, “polyacryllonitryl” should read -- polyacrylonitrile --.

Column 8,
Line 52, “polyacryllonitrile” should read -- polyacrylonitrile --; and
Line 53, ““polyacryllonitrile” should read -- polyacrylonitrile --.

Column 9,
Line 1, “through” should read -- though --;
Line 3, “but” should be deleted; and
Line 56, “thereby forming” should read -- thereby forms --.

Column 10,
Line 17, “Specification,” should read -- specification, --; and
Line 18, “areas,” should read -- areas --.

Column 11,
Line 1, “3') A solution” should read -- ¶ 3') A solution --; and
Line 27, “the” (1st occurrence) should read -- The --.

Column 19,
Line 45, “mixed” should read -- were mixed --.

Column 24,
Line 19, “cess” should read -- cesses --.

Column 27,
Line 31, “Hoechster)” should read -- Hoechst) --.

UNITED STATES PATENT AND TRADEMARK OFFICE

CERTIFICATE OF CORRECTION

PATENT NO. : 6,383,047 B1
DATED : May 7, 2002
INVENTOR(S) : Masato Minami et al.

It is certified that error appears in the above-identified patent and that said Letters Patent is hereby corrected as shown below:

Column 29,
Line 16, “tinuos” should read -- tinuous --.

Column 35,
Line 22, “pruning” should read -- pruning, --;
Line 51, “form” should read -- from --; and
Line 54, “ahs” should read -- has --.

Column 37,
Line 43, “polyacryllo nitryl.” should read -- polyacrylonitrile. --; and
Line 65, “polyacryllo” should read -- polyacrylo- --.

Column 38,
Line 7, “at” should read -- ¶ at --;
Line 9, “polyacryllo nitrile;” should read -- polyacrylonitrile; --;
Line 16, “an electroconductive” should read -- a --;
Line 20, “polyacryllo” should read -- polyacrylo- --;
Line 25, “thereto.” should read -- thereto, wherein the film has a sheet resistance of $10^3$ to $10^7$ Ω/□. --;
Line 26, “according to” should be deleted;
Line 27, should read -- comprising the steps of:

A) a step for forming on a substrate a film comprising:
at --;

Line 29, “and” should be deleted; and
Line 30, “ide.” should read -- ide, and polyacrylonitrile; and an electroconductive material; and B) a step for forming a gap at a portion of said film by applying an electrical current thereto. --.

Column 39,
Line 16, “lest” should read -- least --;
Line 19, “Polyacetylene,” should read -- polyacetylene, --;
Line 25, “polyacryllo nitryl.” should read -- polyacrylonitrile. --;
Line 35, “polubenzoimidazole,” should read -- polybenzoimidazole, --; and
Line 36, “polyacryllonitrile;” should read -- polyacrylonitrile; --.

UNITED STATES PATENT AND TRADEMARK OFFICE

CERTIFICATE OF CORRECTION

PATENT NO. : 6,383,047 B1
DATED : May 7, 2002
INVENTOR(S) : Masato Minami et al.

It is certified that error appears in the above-identified patent and that said Letters Patent is hereby corrected as shown below:

Column 40,
Line 13, “polyacryllonitrile;” should read -- polyacrylonitrile; --;
Line 27, “step” should read -- a step --;
Line 35, “an” should read -- and --;
Line 46, “according” should read -- according to --; and
Line 51, ““polyacryllonitrile;” should read -- polyacrylonitrile; --.

Signed and Sealed this

Twenty-third Day of September, 2003

JAMES E. ROGAN
*Director of the United States Patent and Trademark Office*